US010094601B2

(12) United States Patent
Arino

(10) Patent No.: US 10,094,601 B2
(45) Date of Patent: Oct. 9, 2018

(54) CONDENSER

(71) Applicant: KEIHIN THERMAL TECHNOLOGY CORPORATION, Oyama-shi (JP)

(72) Inventor: Kota Arino, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 0 days.

(21) Appl. No.: 15/626,178

(22) Filed: Jun. 19, 2017

(65) Prior Publication Data

US 2018/0017297 A1 Jan. 18, 2018

(30) Foreign Application Priority Data

Jul. 12, 2016 (JP) ..... 2016-137512
Apr. 18, 2017 (JP) ..... 2017-081750

(51) Int. Cl.

| | |
|---|---|
| ***F28D 7/00*** | (2006.01) |
| ***F28F 9/22*** | (2006.01) |
| ***F25B 39/00*** | (2006.01) |
| *F25B 39/04* | (2006.01) |

(52) U.S. Cl.

CPC ..... *F25B 39/00* (2013.01); *F25B 39/04* (2013.01)

(58) Field of Classification Search

CPC ..... F25B 39/00; F25B 39/04; F25B 40/02; F25B 43/003; F25B 2339/0441; F25B 2339/0444; F28D 1/05375; F28D 1/05316; F28D 1/05324; F28F 27/02; F28F 9/28

USPC ..... 165/159

See application file for complete search history.

(56) References Cited

U.S. PATENT DOCUMENTS

| | | | | |
|---|---|---|---|---|
| 6,935,413 | B2 * | 8/2005 | Kamishima | F25B 39/04 165/110 |
| 2012/0111547 | A1 * | 5/2012 | Suzuki | F25B 39/04 165/173 |
| 2014/0014296 | A1 * | 1/2014 | Arino | F28F 27/02 165/96 |
| 2015/0129187 | A1 | 5/2015 | Nagafuji et al. | |
| 2016/0040916 | A1 * | 2/2016 | Hanafusa | F25B 39/04 165/104.21 |

FOREIGN PATENT DOCUMENTS

| | | |
|---|---|---|
| JP | 2004-353936 | 12/2004 |
| JP | 2015-92120 | 5/2015 |

* cited by examiner

*Primary Examiner* — Davis Hwu
(74) *Attorney, Agent, or Firm* — Mori & Ward, LLP

(57) ABSTRACT

An inlet member having a refrigerant inflow passage which is open at opposite ends is joined to a condensation section inlet header of a condenser. An opening at one end of the refrigerant inflow passage serves as an inflow opening into which externally supplied refrigerant flows, and an opening at the other end serves as an outflow opening from which refrigerant flows out to the condensation section inlet header. The condensation section inlet header has an opening at a position offset from the longitudinal center toward the one end thereof. The inlet member has an insert portion which is inserted into the condensation section inlet header through the opening. The outflow opening of the refrigerant inflow passage is open to a single upward facing flat surface of the insert portion, and is oriented such that the refrigerant flows toward the longitudinal center of the condensation section inlet header.

8 Claims, 17 Drawing Sheets

CONDENSER

BACKGROUND OF THE INVENTION

The present invention relates to a condenser suitable for use in, for example, a car air conditioner mounted on an automobile.

Herein and in the appended claims, the upper side, lower side, left-hand side, and right-hand side of FIGS. 1, 11, 15, and 17 will be referred to as "upper," "lower," "left," and "right," respectively, and a direction perpendicular to the sheets on which FIGS. 1, 11, 15, and 17 are drawn respectively will be referred to as an "air-passing direction."

A widely known condenser for a car air conditioner (hereinafter referred to as the "known condenser") has a condensation section which includes one or more heat exchange paths, a condensation section inlet header, and a condensation section outlet header. Each of the heat exchange paths is formed by a plurality of heat exchange tubes disposed parallel to one another such that their longitudinal direction coincides with the left-right direction and they are spaced from one another in the vertical direction. The condensation section inlet header is disposed such that its longitudinal direction coincides with the vertical direction, and an upstream end (in the refrigerant flow direction) of the heat exchange path located furthest upstream in the refrigerant flow direction communicates with the condensation section inlet header. The condensation section outlet header is disposed such that its longitudinal direction coincides with the vertical direction, and a downstream end (in the refrigerant flow direction) of the heat exchange path located furthest downstream in the refrigerant flow direction communicates with the condensation section outlet header, so that refrigerant having flowed through all the heat exchange paths of the condensation section flows into the condensation section outlet header. An inlet member is joined to the condensation section inlet header and has a refrigerant inflow passage which is open at opposite ends and through which refrigerant flows into the condensation section inlet header. An outlet member is joined to the condensation section outlet header and has a refrigerant outflow passage which is open at opposite ends and through which refrigerant flows out of the condensation section outlet header.

In order to improve the heat exchange efficiency of the above-described known condenser, it is effective to render the flow rate of refrigerant uniform among all the heat exchange tubes constituting the heat exchange path communicating with the condensation section inlet header, by adjusting the vertical position of an inflow opening of the condensation section inlet header through which refrigerant flows into the condensation section inlet header and the vertical position of an outflow opening of the condensation section outlet header through which refrigerant flows out of the condensation section outlet header.

Incidentally, in the case of a car air conditioner mounted on an automobile, in consideration of routing of pipes for connecting components of the car air conditioner, a restriction may be imposed on the vertical position of the inflow opening through which refrigerant flows into the condensation section inlet header of the condenser, and in the above-described known condenser, difficulty may arise in rendering the flow rate of refrigerant uniform among all the heat exchange tubes of the heat exchange path communicating with the condensation section inlet header.

There has been proposed a condenser which can render the flow rate of refrigerant uniform among all the heat exchange tubes of a heat exchange path for refrigerant condensation without adjusting the vertical positions of the refrigerant inflow opening and the refrigerant outflow opening (Japanese Patent Application Laid-Open (kokai) No. 2004-353936). In the proposed condenser, a partition member is disposed in at least one of the condensation section inlet header and the condensation section outlet header so as to divide the interior space into a space on the heat exchange tube side and a space opposite the heat exchange tube side. A plurality of communication holes for establishing communication between the two spaces are provided in the partition member at predetermined intervals in the vertical direction, and the sizes of the communication holes are adjudged in accordance with their positions in the vertical direction.

However, in the proposed condenser, since at least one of the condensation section inlet header and the condensation section outlet header has a partition member for dividing the interior space into a space on the heat exchange tube side and a space opposite the heat exchange tube side, the number of parts increases, and weight and cost increase as a result of an increase in the number of parts.

The applicant of the present invention has proposed a condenser which can render the flow rate of refrigerant uniform among all the heat exchange tubes of a heat exchange path for refrigerant condensation, while suppressing an increase in the number of parts and an increase in cost (Japanese Patent Application Laid-Open (kokai) No. 2015-92120). The proposed condenser has a condensation section, a super-cooling section provided below the condensation section, and a liquid receiving section provided between the condensation section and the super-cooling section. The condensation section includes one or more heat exchange paths, a condensation section inlet header, and a condensation section outlet header. Each of the heat exchange paths is formed by a plurality of heat exchange tubes disposed parallel to one another such that their longitudinal direction coincides with the left-right direction and they are spaced from one another in the vertical direction. An upstream end (in the refrigerant flow direction) of the heat exchange path located furthest upstream in the refrigerant flow direction communicates with the condensation section inlet header. A downstream end (in the refrigerant flow direction) of the heat exchange path located furthest downstream in the refrigerant flow direction communicates with the condensation section outlet header, so that refrigerant having flowed through all the heat exchange paths of the condensation section flows into the condensation section outlet header. The condensation section inlet header has a refrigerant inflow opening at a position offset from the longitudinal center of the condensation section inlet header toward one end thereof. An inlet member is joined to the condensation section inlet header and has a refrigerant inflow passage which is open at opposite ends and through which refrigerant flows into the condensation section inlet header. The super-cooling section includes one or more heat exchange paths for super-cooling, a super-cooling section inlet header, and a super-cooling section outlet header. Each of the heat exchange paths for super-cooling is formed by a plurality of heat exchange tubes disposed parallel to one another such that their longitudinal direction coincides with the left-right direction and they are spaced from one another in the vertical direction. The super-cooling section inlet header is disposed such that its longitudinal direction coincides with the vertical direction, and an upstream end (in the refrigerant flow direction) of the heat exchange path for super-cooling located furthest upstream in the refrigerant flow direction communicates with the super-cooling section inlet header. The super-cooling section outlet header is disposed such that its longitudinal direction coincides with the vertical direction, and a downstream end (in the refrigerant flow direction) of the heat exchange path for super-cooling located furthest downstream in the refrigerant flow direction communicates with the super-cooling section outlet header. An outlet member is joined to the super-cooling section outlet header and has a refrigerant outflow passage which is open at opposite ends and through which refrigerant flows out of the super-cooling section outlet header. The liquid receiving section communicates with the condensation section outlet header and the super-cooling section inlet header, so that the refrigerant having flowed out of the condensation section outlet header flows into the super-cooling section inlet header through the liquid receiving section. The inlet member has a close contact portion which is in close contact with a predetermined region of the outer circumferential surface of the circumferential wall of the condensation section inlet header, the predetermined region containing the refrigerant inlet. The entirety of the refrigerant inflow passage of the inlet member is present outside the condensation section inlet header. An opening at one end of the refrigerant inflow passage of the inlet member serves as an inflow opening into which refrigerant from the outside flows, and an opening at the other end of the refrigerant inflow passage of the inlet member serves as an outflow opening from which refrigerant flows into the condensation section inlet header. The outflow opening is open to the close contact portion such that the outflow opening coincides with the refrigerant inlet of the condensation section inlet header. The refrigerant inflow passage of the inlet member has a straight portion located on the outflow opening side and has a predetermined length, and the straight portion is inclined such that the straight portion approaches the longitudinal center of the condensation section inlet header and the heat exchange tube while extending from the inflow opening side toward the outflow opening side.

However, in this proposed condenser, since the entirety of the refrigerant inflow passage of the inlet member is present outside the condensation section inlet header, the inlet member has a relatively large size, and as a result, the size of the condenser increases, thereby restricting the freedom of layout.

SUMMARY OF THE INVENTION

An object of the present invention is to solve the above-described problem and provide a condenser which can render the flow rate of refrigerant uniform among all the heat exchange tubes of a heat exchange path for refrigerant condensation, without increasing the number of parts, and which can be reduced in size.

A condenser according to the present invention includes a condensation section inlet header disposed such that its longitudinal direction coincides with a vertical direction; and a heat exchange path formed by a plurality of heat exchange tubes disposed parallel to one another such that their longitudinal direction coincides with a left-right direction and they are spaced from one another in the vertical direction, each of heat exchange tubes being connected, at one longitudinal end thereof, to the condensation section inlet header. An inlet member joined to the condensation section inlet header has a refrigerant inflow passage which is open at opposite ends thereof and through which refrigerant flows to a region within the condensation section inlet header, the region being offset from a longitudinal center of the condensation section inlet header toward one end of the condensation section inlet header. An opening at one end of the refrigerant inflow passage of the inlet member serving as an inflow opening into which the refrigerant flows from the outside, and an opening at the other end of the refrigerant inflow passage serving as an outflow opening from which the refrigerant flows out to the condensation section inlet header. The condensation section inlet header has an opening formed in a circumferential wall of the condensation section inlet header at a position offset from the longitudinal center toward the one end of the condensation section inlet header. The inlet member has an insert portion which is inserted into the condensation section inlet header through the opening. The outflow opening of the refrigerant inflow passage is open to a surface of the insert portion, and the outflow opening of the refrigerant inflow passage is oriented such that the refrigerant flows toward the longitudinal center of the condensation section inlet header.

DESCRIPTION OF THE PREFERRED EMBODIMENTS

Figure 1:
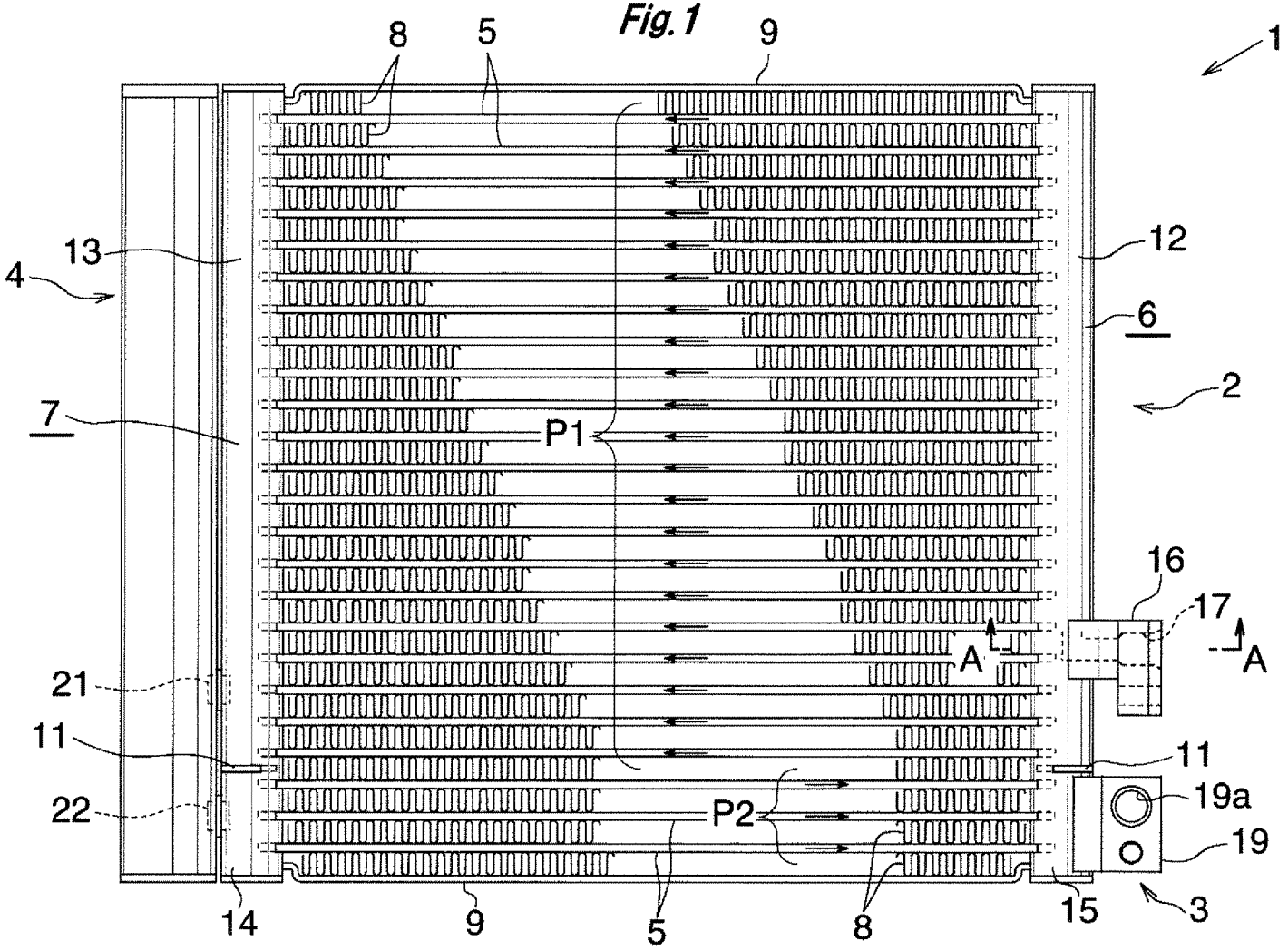
FIG. 1 is a front view specifically showing the overall structure of a first embodiment of the condenser according to the present invention.

Embodiments of the present invention will next be described with reference to the drawings.

The term "aluminum" as used in the following description encompasses aluminum alloys in addition to pure aluminum.

Like portions and components are denoted by like reference numerals throughout the drawings.

Figure 2:
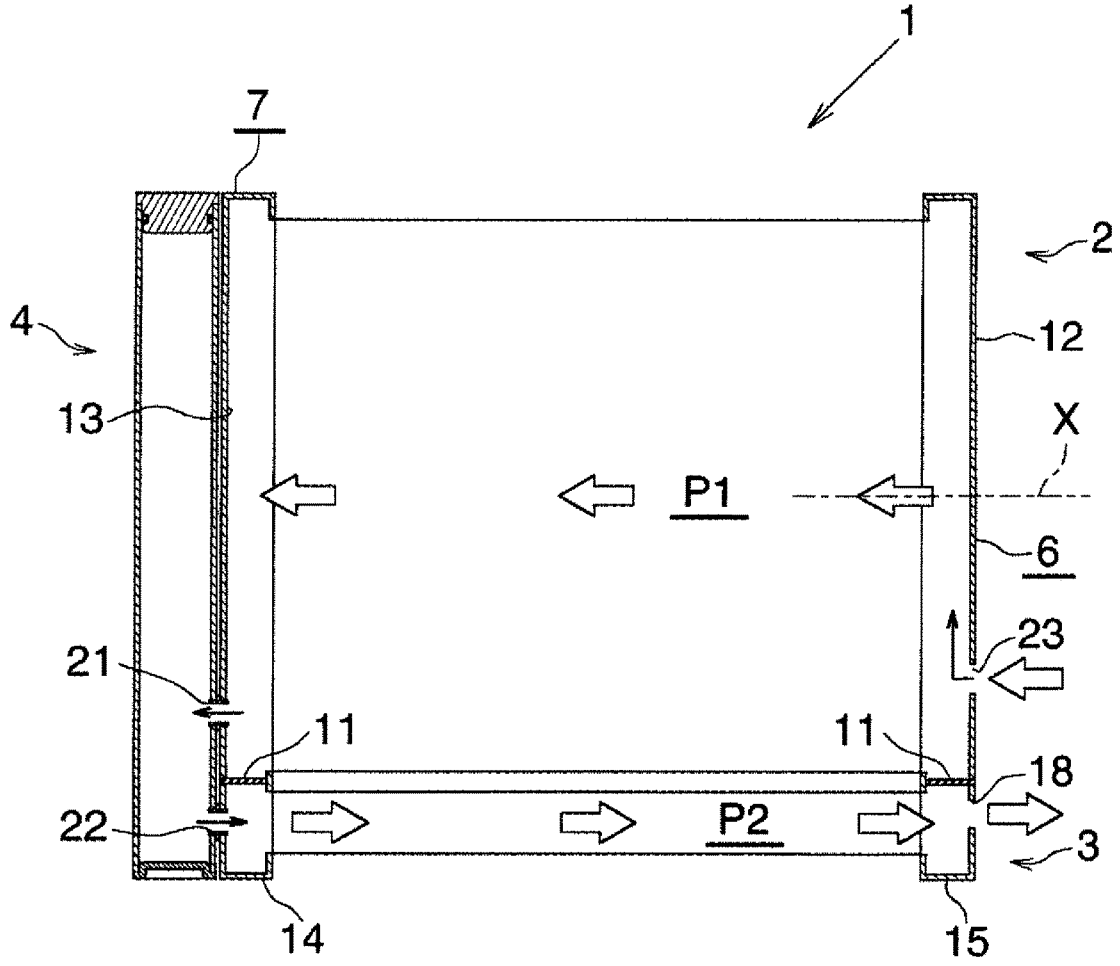
FIG. 2 is a front view schematically showing the condenser of FIG. 1.
Figure 3:
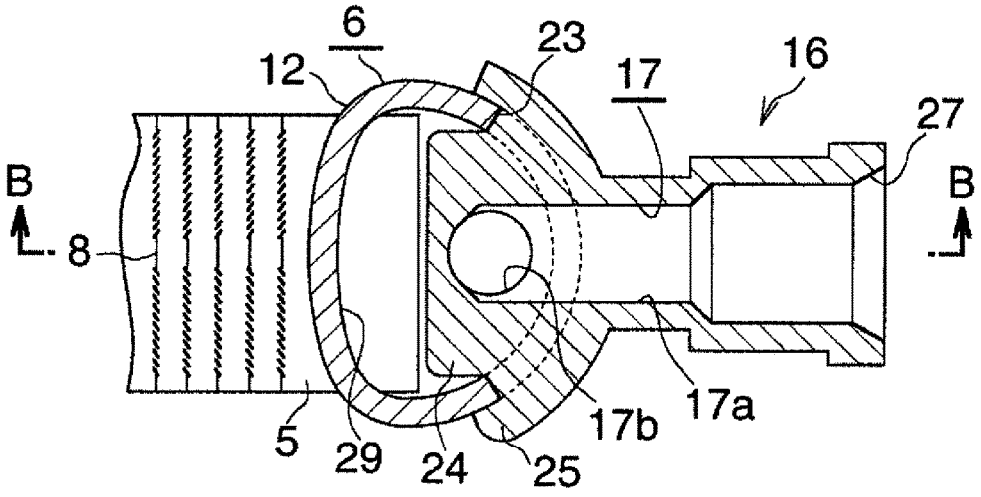
FIG. 3 is an enlarged sectional view taken along line A-A of FIG. 1.
Figure 4:
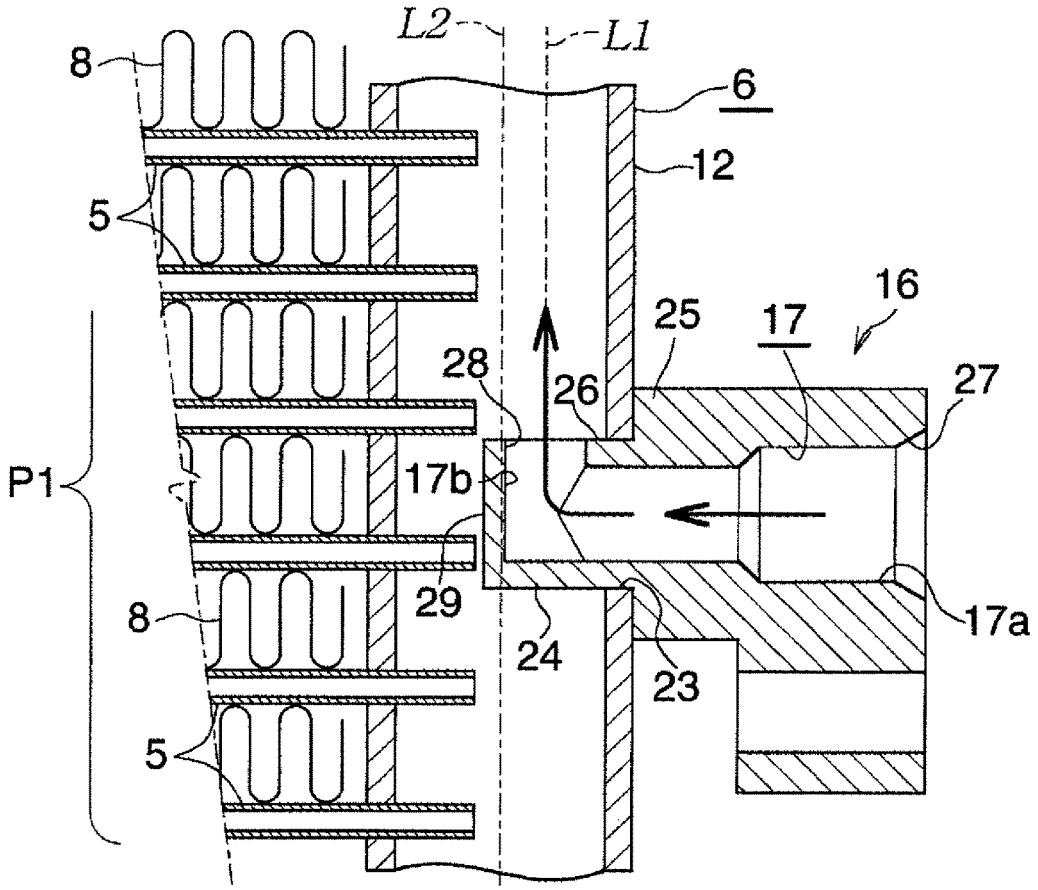
FIG. 4 is a sectional view taken along line B-B of FIG. 3.
Figure 5:
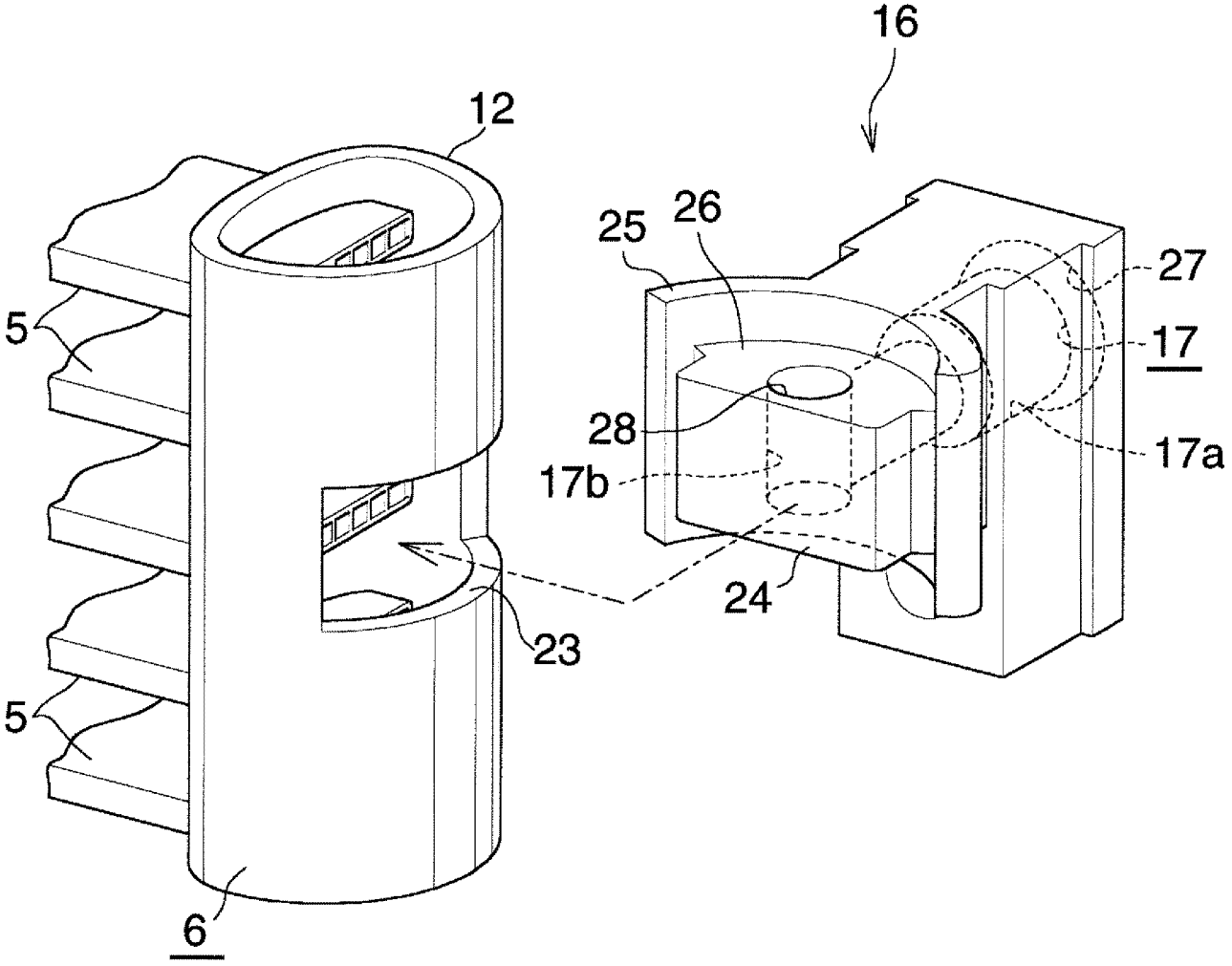
FIG. 5 is an exploded perspective view showing an inlet member and a portion of a condensation section inlet header of the condenser shown in FIG. 1.

FIG. 1 specifically shows the overall structure of a first embodiment of the condenser according to the present invention. FIG. 2 schematically shows the condenser of FIG. 1. FIGS. 3 through 5 show the structure of a main portion of the condenser of FIG. 1. In FIG. 2, individual heat exchange tubes are not illustrated, and corrugate fins and side plates are also not illustrated.

In FIGS. 1 and 2, a condenser 1 is composed of a condensation section 2; a super-cooling section 3 provided below the condensation section 2; and a tank-like liquid receiver 4 (liquid receiving section) which is formed of aluminum and is provided between the condensation section 2 and the super-cooling section 3 such that the longitudinal direction of the liquid receiver 4 coincides with the vertical direction. The liquid receiver 4 functions as a liquid reservoir section which reserves liquid phase predominant refrigerant produced as a result of condensation at the condensation section 2 and supplies the liquid phase predominant refrigerant to the super-cooling section 3. The condenser 1 includes a plurality of flat heat exchange tubes 5 formed of aluminum, two header tanks 6 and 7 formed of aluminum, corrugate fins 8 formed of aluminum, and side plates 9 formed of aluminum. The heat exchange tubes 5 are disposed such that their width direction coincides with an air-passing direction, their longitudinal direction coincides with the left-right direction, and they are spaced from one another in the vertical direction. The header tanks 6 and 7 are disposed such that their longitudinal direction coincides with the vertical direction and they are spaced from each other in the left-right direction, and left and right end portions of the heat exchange tubes 5 are brazed to the header tanks 6 and V. Each of the corrugate fins 8 is disposed between and brazed to adjacent heat exchange tubes 5, or is disposed on the outer side of the uppermost or lowermost heat exchange tube 5 and joined to the corresponding heat exchange tube 5 through use of a brazing material. The side plates 9 are disposed on the corresponding outer sides of the uppermost and lowermost corrugate fins 8, and are joined to these corrugate fins 8 through use of a brazing material. In the following description, joining through use of a brazing material will also referred to as "brazing."

Each of the condensation section 2 and the super-cooling section 3 of the condenser 1 includes at least one heat exchange path (in the present embodiment, one heat exchange path P1, P2) formed by a plurality of heat exchange tubes 5 successively arranged in the vertical direction. The heat exchange path P1 provided in the condensation section 2 serves as a refrigerant condensation path. The heat exchange path P2 provided in the super-cooling section 3 serves as a refrigerant super-cooling path. The flow direction of refrigerant is the same among all the heat exchange tubes 5 which form each heat exchange path P1, P2. The flow direction of refrigerant in the heat exchange tubes 5 which form a certain heat exchange path is opposite the flow direction of refrigerant in the heat exchange tubes 5 which form another heat exchange path adjacent to the certain heat exchange path. The heat exchange path P1 of the condensation section 2 will be referred to as the first heat exchange path, and the heat exchange path P2 of the super-cooling section 3 will be referred to as the second heat exchange path. In the present embodiment, since the single first heat exchange path P1 is provided in the condensation section 2, the first heat exchange path P1 serves as a heat exchange path located furthest upstream in the refrigerant flow direction in the condensation section 2 and also serves as a heat exchange path located furthest downstream in the refrigerant flow direction in the condensation section 2.

The header tanks 6 and 7 have respective partition members 11 which are formed of aluminum and are provided at the same vertical position on the lower side between the first heat exchange path P1 and the second heat exchange path P2 so as to divide the interior spaces of the header tanks 6 and 7 into upper and lower spaces. A portion of the condenser 1 located on the upper side of the two partition members 11 is the condensation section 2, and a portion of the condenser 1 located on the lower side of the two partition members 11 is the super-cooling section 3. Since the single first heat exchange path P1 is provided in the condensation section 2, the space of the right header tank 6 located above the corresponding partition member 11 serves as a condensation section inlet header 12, and the space of the left header tank 7 located above the corresponding partition member 11 serves as a condensation section outlet header 13. Also, since the single second heat exchange path P2 is provided in the super-cooling section 3, the space of the left header tank 7 located below the corresponding partition member 11 serves as a super-cooling section inlet header 14, and the space of the right header tank 6 located below the corresponding partition member 11 serves as a super-cooling section outlet header 15.

An inlet member 16 formed of aluminum is brazed to the outer circumferential surface of the circumferential wall of the condensation section inlet header 12 to be located at a position offset from its longitudinal center X toward one end (lower end in the present embodiment) thereof. The inlet member 16 has a refrigerant inflow passage 17 which is open at opposite ends and through which refrigerant flows into the condensation section inlet header 12. Also, an outlet member 19 formed of aluminum is brazed to the outer circumferential surface of the circumferential wall of the super-cooling section outlet header 15 to be located at a position offset from its longitudinal center toward an upper end thereof. The outlet member 19 has a refrigerant outflow passage 19*a* which is open at opposite ends, and refrigerant flowing out of the super-cooling section outlet header 15 through a refrigerant outlet 18 formed therein flows out to the outside through the refrigerant outflow passage 19*a*.

The liquid receiver 4 is formed of aluminum and has the shape of a circular tube. The liquid receiver 4 is disposed such that its longitudinal direction coincides with the vertical direction and is closed at the upper and lower ends. The liquid receiver 4 is provided separately from the left header tank 7 (the condensation section outlet header 13 and the super-cooling section inlet header 14) and is fixed to the left header tank 7. Although not illustrated, a desiccant and a filter for removing foreign substances from refrigerant are disposed in the liquid receiver 4. Communication members 21 and 22 formed of aluminum are brazed to the left header tank 7 and the liquid receiver 4. The communication member 21 establishes communication between a lower portion of the interior space of the condensation section outlet header 13 and a lower portion of the interior space of the liquid receiver 4. The communication member 22 establishes communication between an upper portion of the interior space of the super-cooling section inlet header 14 and a lower portion of the interior space of the liquid receiver 4. As a result, refrigerant flowing out of the condensation section outlet header 13 flows into the super-cooling section inlet header 14 through the liquid receiver 4.

As shown in FIGS. 3 through 5, an opening 23 is formed in the circumferential wall of the condensation section inlet header 12 of the right header tank 6 to be located at a vertical position which is offset from the longitudinal center X toward the lower end side (in the present embodiment, a vertical position near the lower end of the condensation section inlet header 12 and near the communication member 21 for establishing communication between the condensation section outlet header 13 and the liquid receiver 4). The inlet member 16 has an insert portion 24 which is inserted into the condensation section inlet header 12 through the opening 23. The insert portion 24 is provided such that a gap 29 is present between the insert portion 24 and a portion of the circumferential wall of the condensation section inlet header 12, and the insert portion 24 does not interfere with the heat exchange tubes 5 of the first heat exchange path P1.

The inlet member 16 has a close contact portion 25 which is located outside the condensation section inlet header 12, extends around the insert portion 24, and is in contact with the outer circumferential surface of the circumferential wall of the condensation section inlet header 12 in a region around the opening 23. The inlet member 16 is brazed to the outer circumferential surface of the circumferential wall of the condensation section inlet header 12 in a state in which the insert portion 24 is inserted into the condensation section inlet header 12 through the opening 23 and the close contact portion 25 is brought into close contact with a portion of the outer circumferential surface of the circumferential wall of the condensation section inlet header 12, the portion extending around the opening 23.

One end of the refrigerant inflow passage 17 of the inlet member 16 is open to a right side surface of a portion of the inlet member 16, which portion is located outside the condensation section inlet header 12. The other end of the refrigerant inflow passage 17 is open to an upper surface of the insert portion 24, which surface is composed of a single flat surface 26. The opening at the one end of the refrigerant inflow passage 17 serves as an inflow opening 27 into which refrigerant flows from the outside, and the opening at the other end of the refrigerant inflow passage 17 serves as an outflow opening 28 from which refrigerant flows into the condensation section inlet header 12. The flat surface 26 of the insert portion 24 where the outflow opening 28 of the inlet member 16 is located, is a horizontal surface, and a first straight line L1 orthogonal to the flat surface 26 is located on a plane perpendicularly intersecting the air-passing direction. Refrigerant flows toward the longitudinal center X of the condensation section inlet header 12 (upward in the present embodiment) through the outflow opening 28. Also, the first straight line L1, which is orthogonal to the flat surface 26 where the outflow opening 28 of the inlet member 16 is located and passes through the center of the outflow opening 28, extends in the longitudinal direction of the condensation section inlet header 12. In the present embodiment, the first straight line L1 is parallel to a second straight line L2 which passes through the center of the condensation section inlet header 12 with respect to the left-right direction and extends in the longitudinal direction of the condensation section inlet header 12. The refrigerant inflow passage 17 of the inlet member 16 is composed of a horizontal first straight portion 17*a* which extends leftward from the right side surface of the inlet member 16 and reaches the interior of the condensation section inlet header 12, and a vertical second straight portion 17*b* which is connected to the left end of the first straight portion 17*a*, extends upward, and is open to the flat surface 26. The inlet member 16 is a single member formed by cutting an aluminum bare material.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into a lower portion of the interior space of the condensation section inlet header 12 through the refrigerant inflow passage 17 of the inlet member 16. At that time, the refrigerant flows out upward (toward the longitudinal center X of the condensation section inlet header 12) from the outflow opening 28 of the inlet member 16. Therefore, a large part of the refrigerant flows to an upper end portion of the interior space of the condensation section inlet header 12, and the remaining refrigerant flows to a region below the inlet member 16 through the gap 29 between the insert portion 24 of the inlet member 16 and the circumferential wall of the condensation section inlet header 12. Accordingly, the refrigerant having flowed into the interior space of the condensation section inlet header 12 through the refrigerant inflow passage 17 of the inlet member 16 spreads to the entire interior space of the condensation section inlet header 12, and flows into all the heat exchange tubes 5 of the first heat exchange path P1 connected to the condensation section inlet header 12 while being equally divided among all the heat exchange tubes 5. The refrigerant having flowed into the heat exchange tubes 5 of the first heat exchange path P1 flows leftward within the heat exchange tubes 5 of the first heat exchange path P1 and flows into the condensation section outlet header 13. The refrigerant having flowed into the condensation section outlet header 13 flows into the liquid receiver 4 through the communication member 21.

The refrigerant having flowed into the liquid receiver 4 is in a gas-liquid mixed phase, and liquid phase predominant refrigerant which is a portion of the gas-liquid mixed phase refrigerant accumulates in a lower portion of the interior space of the liquid receiver 4 due to the gravitational force, and enters the super-cooling section inlet header 14 through the communication member 22. The refrigerant having entered the super-cooling section inlet header 14 enters the heat exchange tubes 5 of the second heat exchange path P2 and is super-cooled while flowing rightward within the flow channels of the heat exchange tubes 5 of the second heat exchange path P2. Subsequently, the super-cooled refrigerant enters the super-cooling section outlet header 15 and flows out through the refrigerant outlet 18 and the refrigerant outflow passage 19*a* of the outlet member 19. The refrigerant is then fed to the evaporator through the expansion valve.

FIGS. 6 through 10 show modifications of the inlet member used in the condenser 1 shown in FIGS. 1 and 2.

Figure 6:
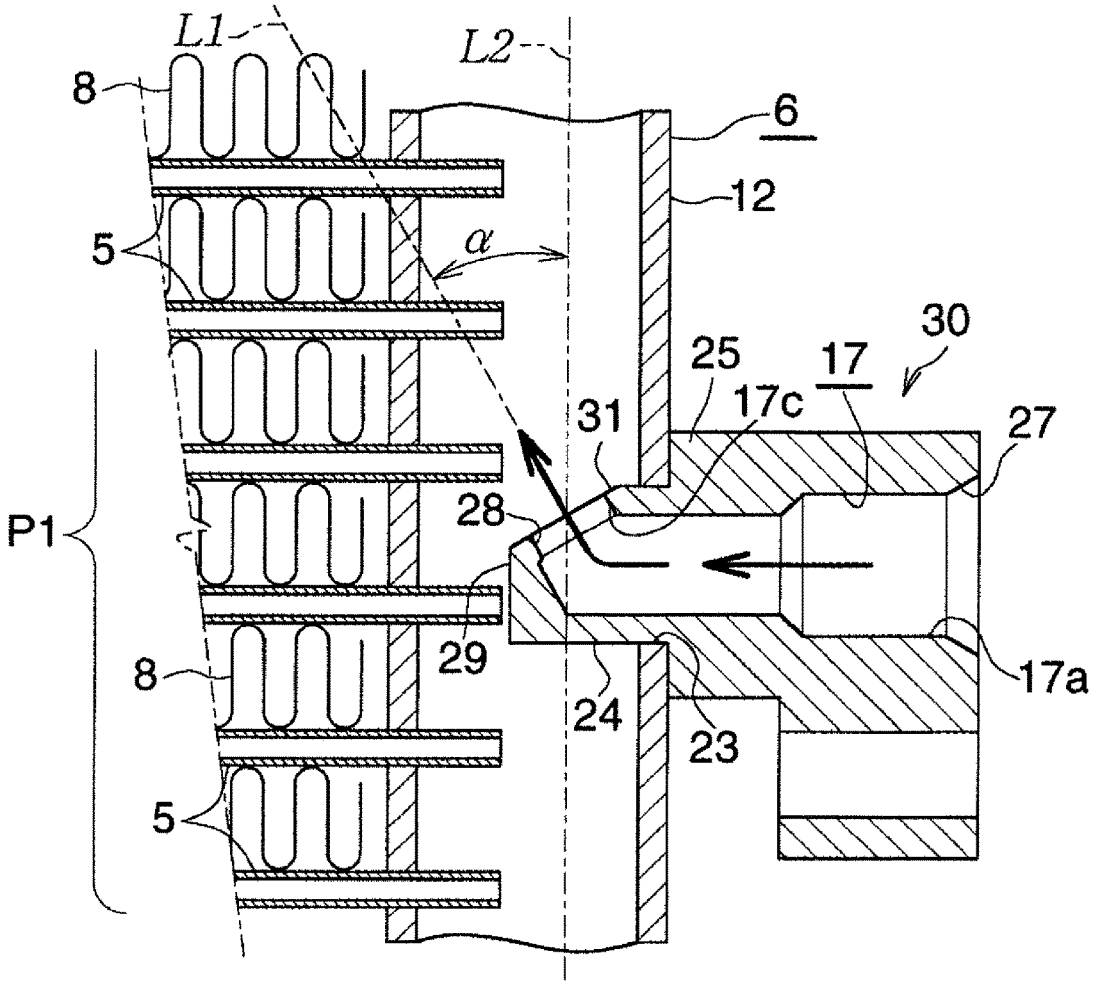
FIG. 6 is a view corresponding to FIG. 4 and showing a first modification of the inlet member used in the condenser of FIG. 1.

In the case of an inlet member 30 shown in FIG. 6, the outflow opening 28 of the refrigerant inflow passage 17 of the inlet member 30 is open to a sloping upward facing surface of the insert portion 24 which is composed of a single flat surface 31. The flat surface 31 of the insert portion 24 of the inlet member 30 where the outflow opening 28 is located is a sloping surface which faces upward obliquely, and the first straight line L1 orthogonal to the flat surface 31 is located on the plane perpendicularly intersecting the air-passing direction. The first straight line L1, which passes through the center of the outflow opening 28 of the inlet member 30 and is orthogonal to the flat surface 31 where the outflow opening 28 is located, is inclined in a direction (toward the heat exchange tubes 5 side in the present modification) such that the distance of separation from the second straight line L2, which passes through the center of the outflow opening 28 and extends in the longitudinal direction of the condensation section inlet header 12, increases with the distance of separation from the flat plane 31 toward the longitudinal center of the condensation section inlet header 12 (toward the upper side). The first straight line L1 forms a predetermined angle a with the second straight line L2, which extends in the longitudinal direction of the condensation section inlet header 12. The angle $\alpha$ formed between the two straight lines L1 and L2 is greater than 0° but not greater than 45°; for example, 30°.

The refrigerant inflow passage 17 of the inlet member 30 is composed of a horizontal first straight portion 17*a* which extends leftward from the right side surface of the inlet member 30 and reaches the interior of the condensation section inlet header 12, and an inclined, short second straight portion 17*c* which is connected to the left end of the first straight portion 17*a*, extends upward obliquely, and is open to the flat surface 31. The inlet member 30 is a single member formed by cutting an aluminum bare material.

Figure 7:
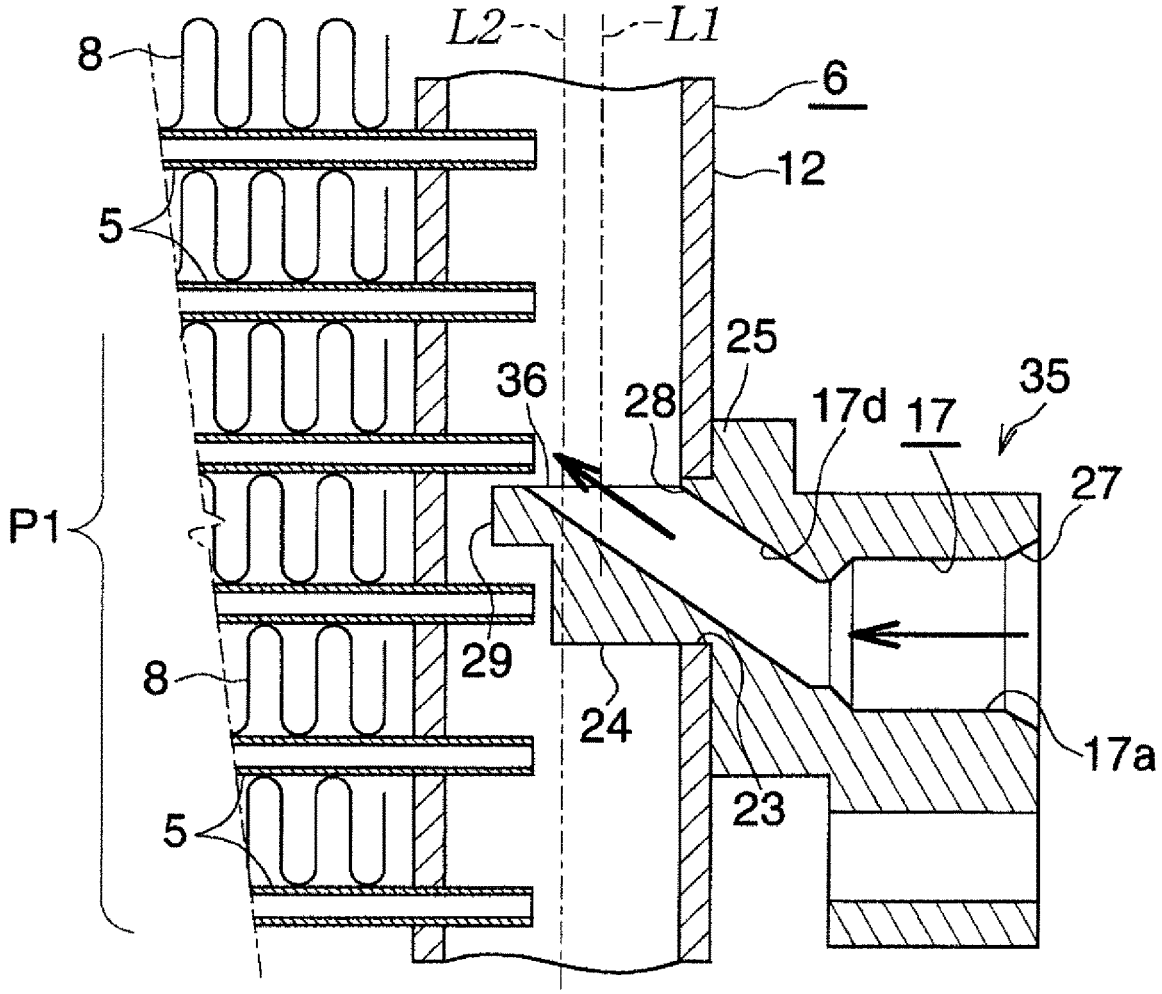
FIG. 7 is a view corresponding to FIG. 4 and showing a second modification of the inlet member used in the condenser of FIG. 1.

In the case of an inlet member 35 shown in FIG. 7, the outflow opening 28 of the refrigerant inflow passage 17 of the inlet member 35 is open to the upper surface of the insertion portion 24 which is composed of a single flat surface 36. The flat surface 36 of the insert portion 24 of the inlet member 35 where the outflow opening 28 is located is a horizontal surface, and the first straight line L1 orthogonal to the flat surface 36 is located on the plane perpendicularly intersecting the air-passing direction. Refrigerant flows toward the longitudinal center of the condensation section inlet header 12 (upward in the present modification) through the outflow opening 28. Also, the first straight line L1, which is orthogonal to the flat surface 36 of the inlet member 35 where the outflow opening 28 is located and passes through the center of the outflow opening 28, extends in the longitudinal direction of the condensation section inlet header 12. In the present modification, the first straight line L1 is parallel to a second straight line L2 which passes through the center of the condensation section inlet header 12 with respect to the left-right direction and extends in the longitudinal direction of the condensation section inlet header 12. The refrigerant inflow passage 17 of the inlet member 35 is composed of a horizontal first straight portion 17*a* which extends leftward from the right side surface of the inlet member 35 and reaches the interior of the condensation section inlet header 12, and a sloping second straight portion 17*d* which is connected to the left end of the first straight portion 17*a*, extends upward obliquely, and is open to the flat surface 36. The second straight portion 17*d* is inclined such that the second straight portion 17*d* approaches the longitudinal center X of the condensation section inlet header 12 and the heat exchange tubes 5 side (the left side) while extending from the inflow opening 27 side toward the outflow opening 28 side. Notably, the insert portion 24 does not interfere with the heat exchange tubes 5 of the first heat exchange path P1, and a gap 29 is present between the insert portion 24 and the circumferential wall of the condensation section inlet header 12. The inlet member 35 is a single member formed by cutting an aluminum bare material.

Figure 8:
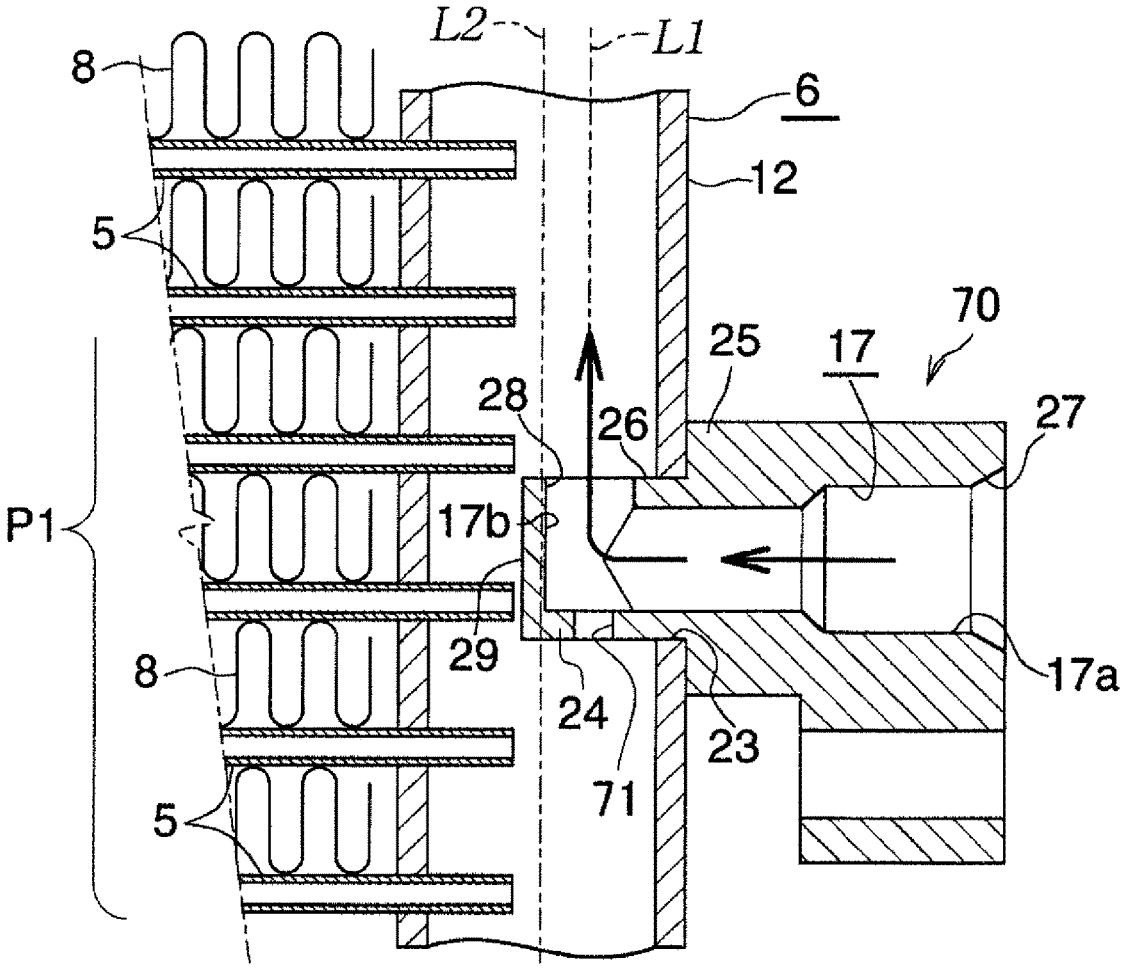
FIG. 8 is a view corresponding to FIG. 4 and showing a third modification of the inlet member used in the condenser of FIG. 1.

In the case of an inlet member 70 shown in FIG. 8, a vertical auxiliary refrigerant inflow passage 71 is formed in the insert portion 24. One end of the auxiliary refrigerant inflow passage 71 is open to the bottom surface of the second straight portion 17*b* of the refrigerant inflow passage 17, and the other end of the auxiliary refrigerant inflow passage 71 is open to a horizontal lower surface of the insert portion 24, which surface faces toward the side opposite the longitudinal center of the condensation section inlet header 12. The flow passage cross sectional area of the auxiliary refrigerant inflow passage 71 is constant over the entire length and is smaller than that of the second straight portion 17*b* of the refrigerant inflow passage 17. The size of the lower end opening of the auxiliary refrigerant inflow passage 71 is smaller than that of the outflow opening 28. The inlet member 70 is a single member formed by cutting an aluminum bare material.

The remaining structure of the inlet member 70 is the same as the inlet member 16 shown in FIG. 4.

In a condenser 1 having the inlet member 70, the refrigerant flowing through the refrigerant inflow passage 17 of the inlet member 70 flows out upward from the outflow opening 28 of the inlet member 70 and, at the same time, the refrigerant flows out to a region within the condensation section inlet header 12 located below the inlet member 70 through the auxiliary refrigerant inflow passage 71. Accordingly, even in the case where, due to the specifications of the condensation section inlet header 12 and the heat exchange tubes 5, the refrigerant having flowed into the condensation section inlet header 12 from the outflow opening 28 of the insert portion 24 of the inlet member 70 encounters difficulty in flowing into the region below the inlet member 70 through the gap 29 between the insert portion 24 and the circumferential wall of the condensation section inlet header 12, the refrigerant can be caused to spread through the entire interior space of the condensation section inlet header 12 in the longitudinal direction, whereby the refrigerant flows into all the heat exchange tubes 5 of the first heat exchange path P1 connected to the condensation section inlet header 12 while being equally divided among the heat exchange tubes 5.

Figure 9:
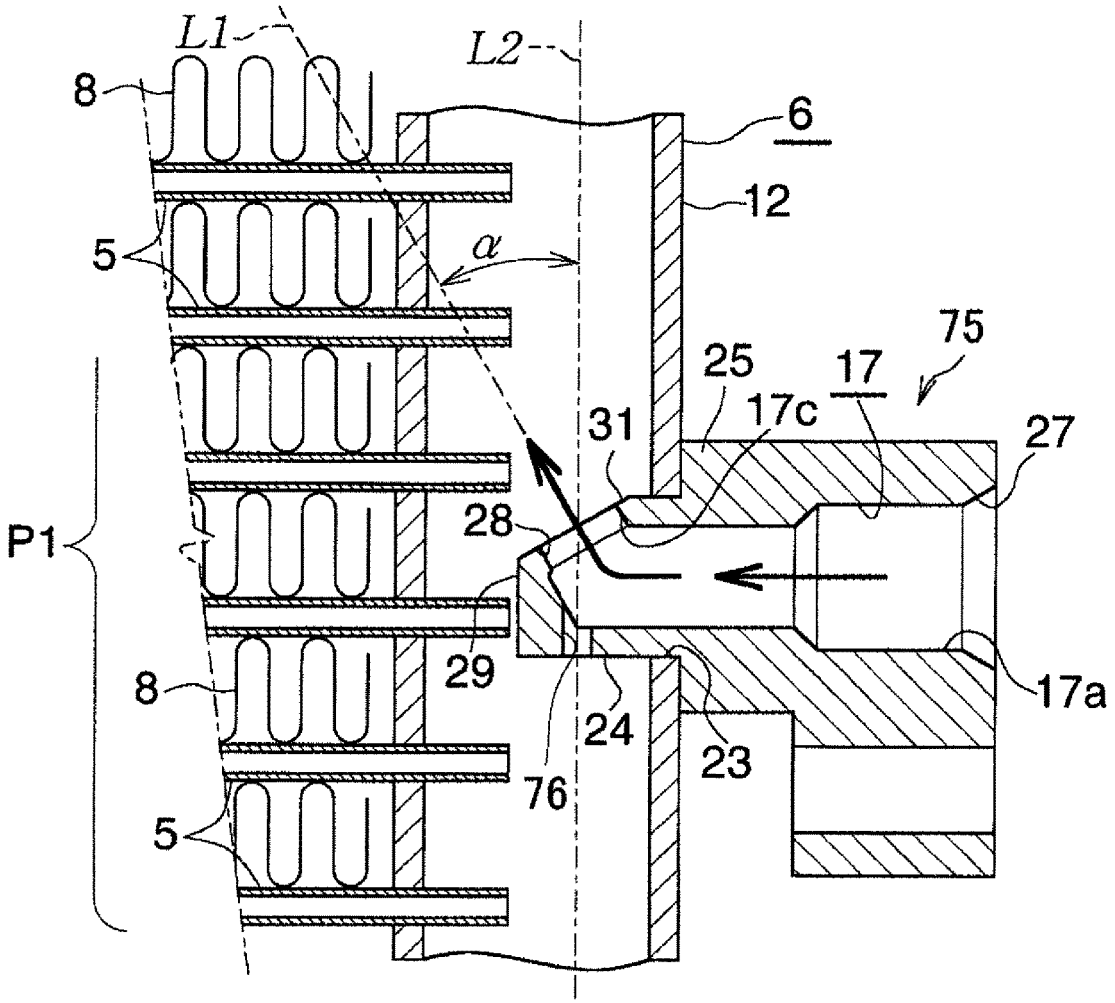
FIG. 9 is a view corresponding to FIG. 4 and showing a fourth modification of the inlet member used in the condenser of FIG. 1.

In the case of an inlet member 75 shown in FIG. 9, a vertical auxiliary refrigerant inflow passage 76 is formed in the insert portion 24. One end of the auxiliary refrigerant inflow passage 76 is open to the bottom surface of a connection portion between the first straight portion 17*a* and the second straight portion 17*c* of the refrigerant inflow passage 17, and the other end of the auxiliary refrigerant inflow passage 76 is open to a horizontal lower surface of the insert portion 24, which surface faces toward the side opposite the longitudinal center of the condensation section inlet header 12. The flow passage cross sectional area of the auxiliary refrigerant inflow passage 76 is constant over the entire length and is smaller than that of the second straight portion 17*c* of the refrigerant inflow passage 17. The size of the lower end opening of the auxiliary refrigerant inflow passage 76 is smaller than that of the outflow opening 28. The inlet member 75 is a single member formed by cutting an aluminum bare material.

The remaining structure of the inlet member 75 is the same as the inlet member 30 shown in FIG. 6.

Figure 10:
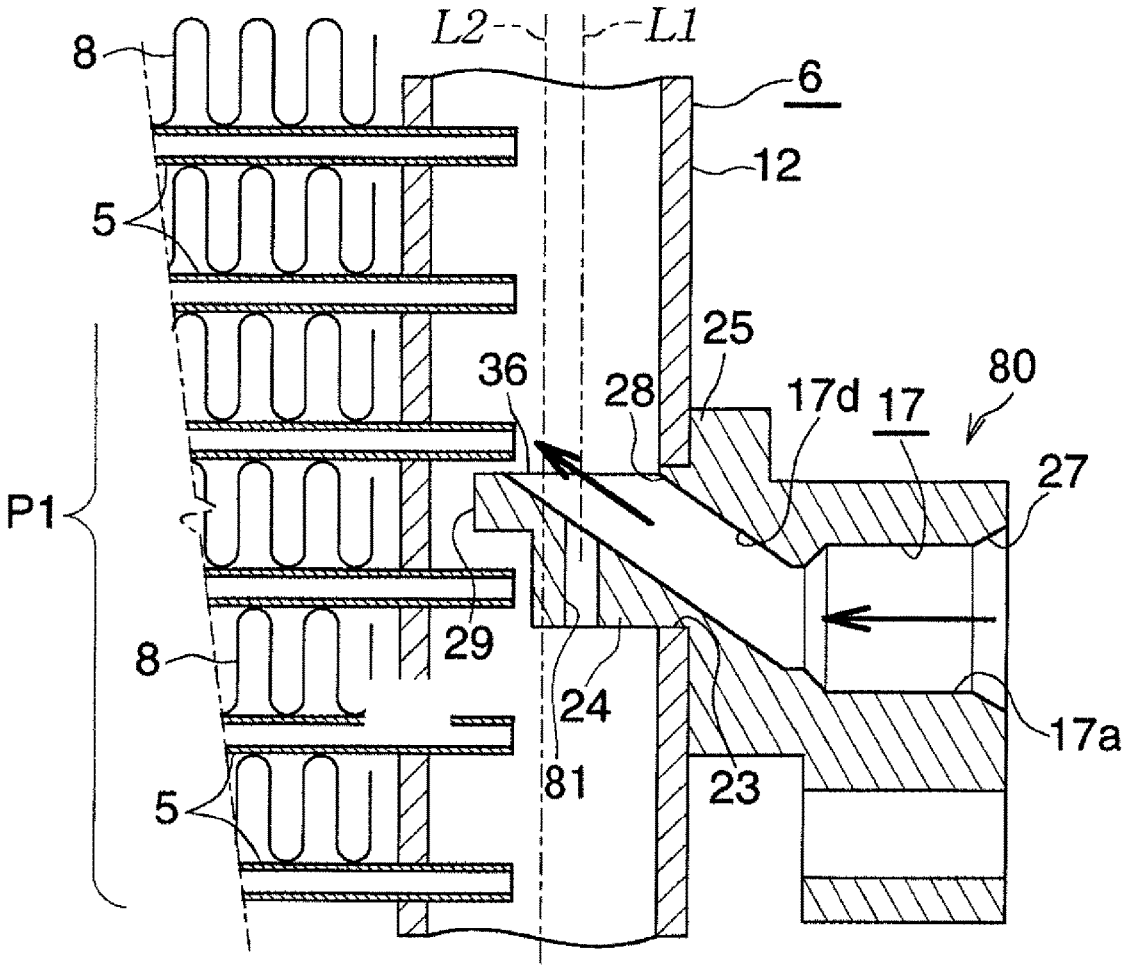
FIG. 10 is a view corresponding to FIG. 4 and showing a fifth modification of the inlet member used in the condenser of FIG. 1.

In the case of an inlet member 80 shown in FIG. 10, a vertical auxiliary refrigerant inflow passage 81 is formed in the insert portion 24. One end of the auxiliary refrigerant inflow passage 81 is open to the bottom surface of a longitudinal intermediate portion of the second straight portion 17*d* of the refrigerant inflow passage 17, and the other end of the auxiliary refrigerant inflow passage 81 is open to a horizontal lower surface of the insert portion 24, which surface faces toward the side opposite the longitudinal center of the condensation section inlet header 12. The flow passage cross sectional area of the auxiliary refrigerant inflow passage 81 is constant over the entire length and is smaller than that of the second straight portion 17*d* of the refrigerant inflow passage 17. The size of the lower end opening of the auxiliary refrigerant inflow passage 81 is smaller than that of the outflow opening 28. The inlet member 80 is a single member formed by cutting an aluminum bare material.

The remaining structure of the inlet member 80 is the same as the inlet member 35 shown in FIG. 7.

In a condenser 1 having the inlet member 75 shown in FIG. 9 or the inlet member 80 shown in FIG. 10 as well, the refrigerant flowing through the refrigerant inflow passage 17 of the inlet member 75 or 80 flows out upward from the outflow opening 28 of the inlet member 75 or 80 and, at the same time, the refrigerant flows out to a region within the condensation section inlet header 12 located below the inlet member 75 or 80 through the auxiliary refrigerant inflow passage 76 or 81.

Figure 11:
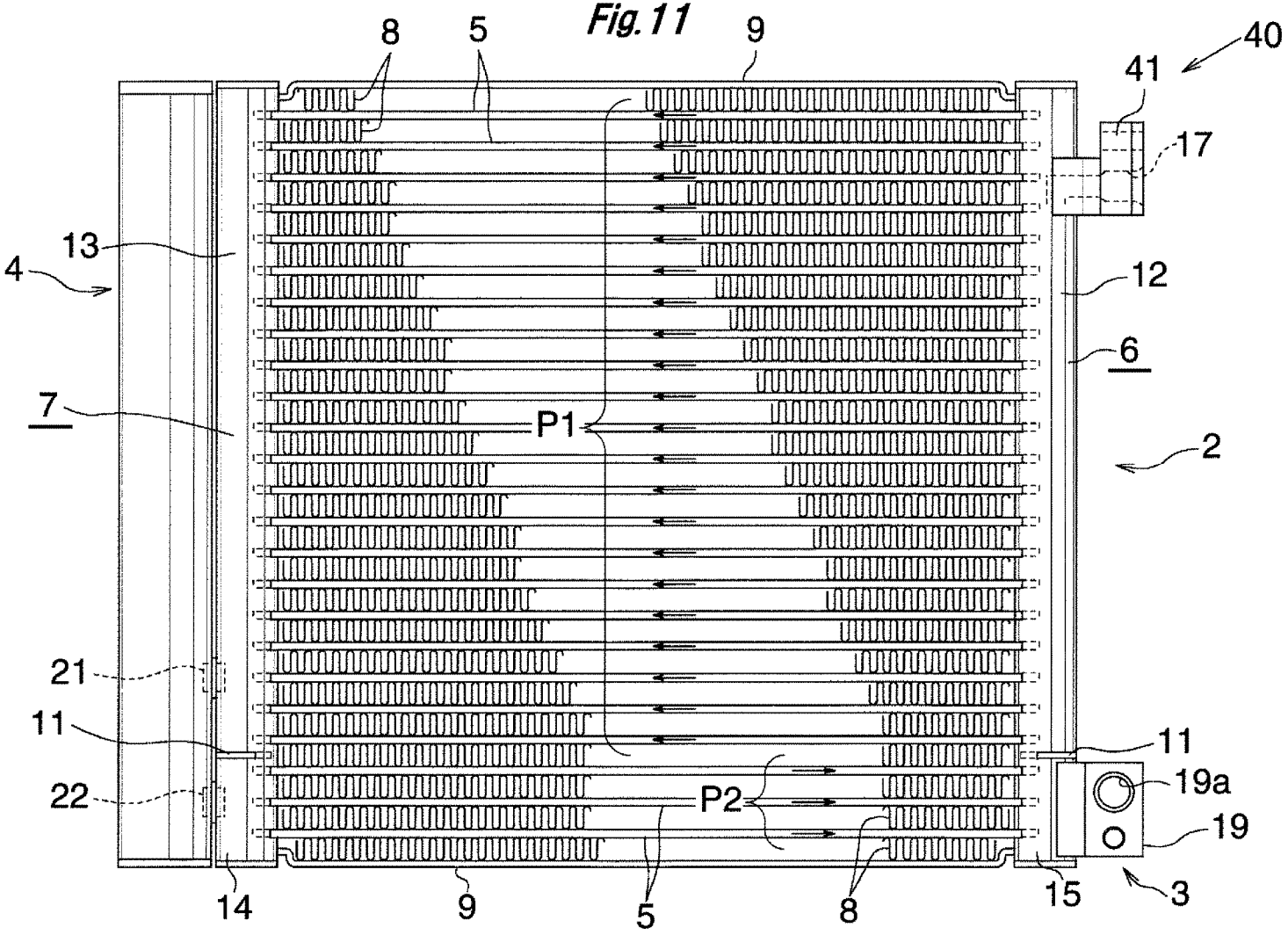
FIG. 11 is a front view specifically showing the overall structure of a second embodiment of the condenser according to the present invention.
Figure 12:
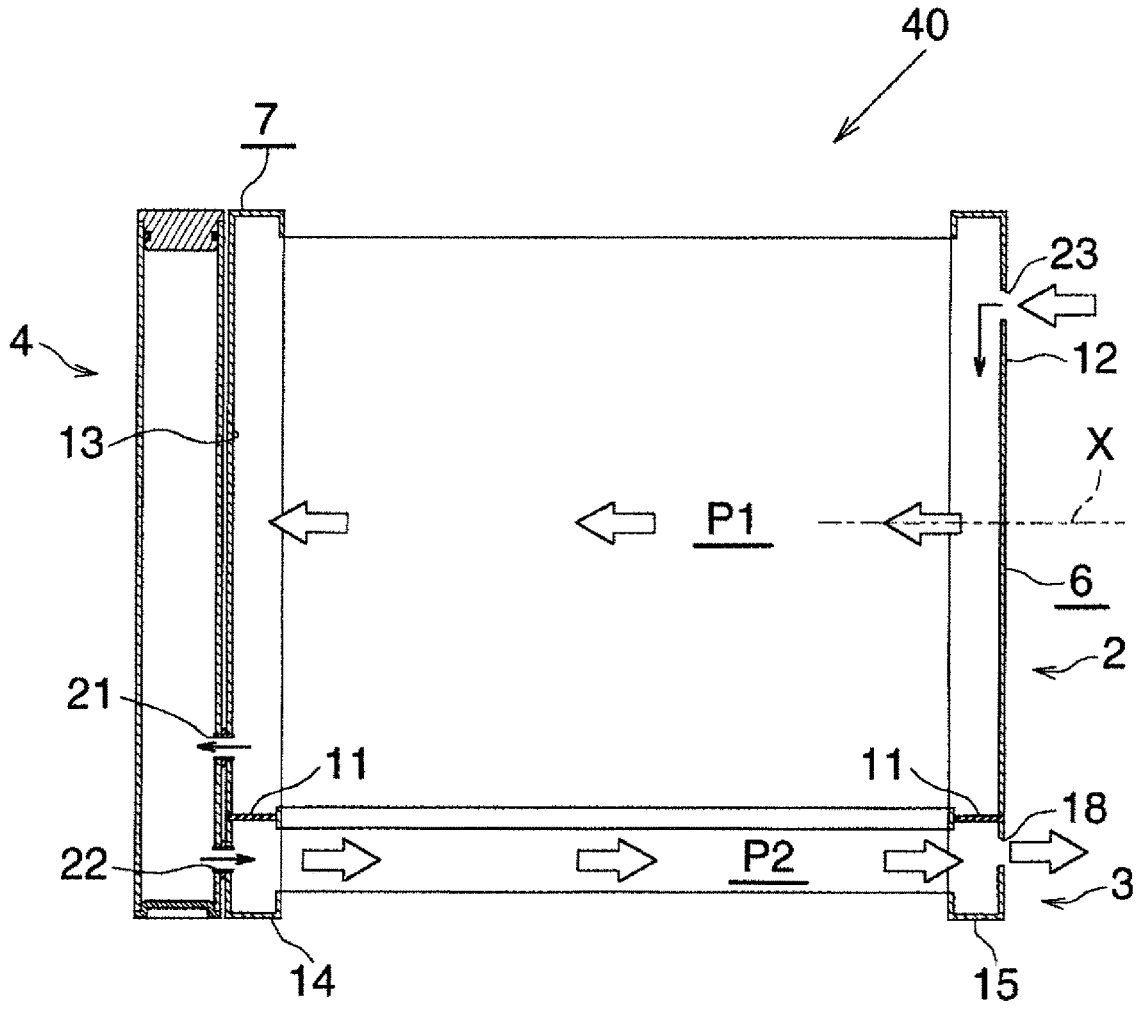
FIG. 12 is a front view schematically showing the condenser of FIG. 11.
Figure 13:
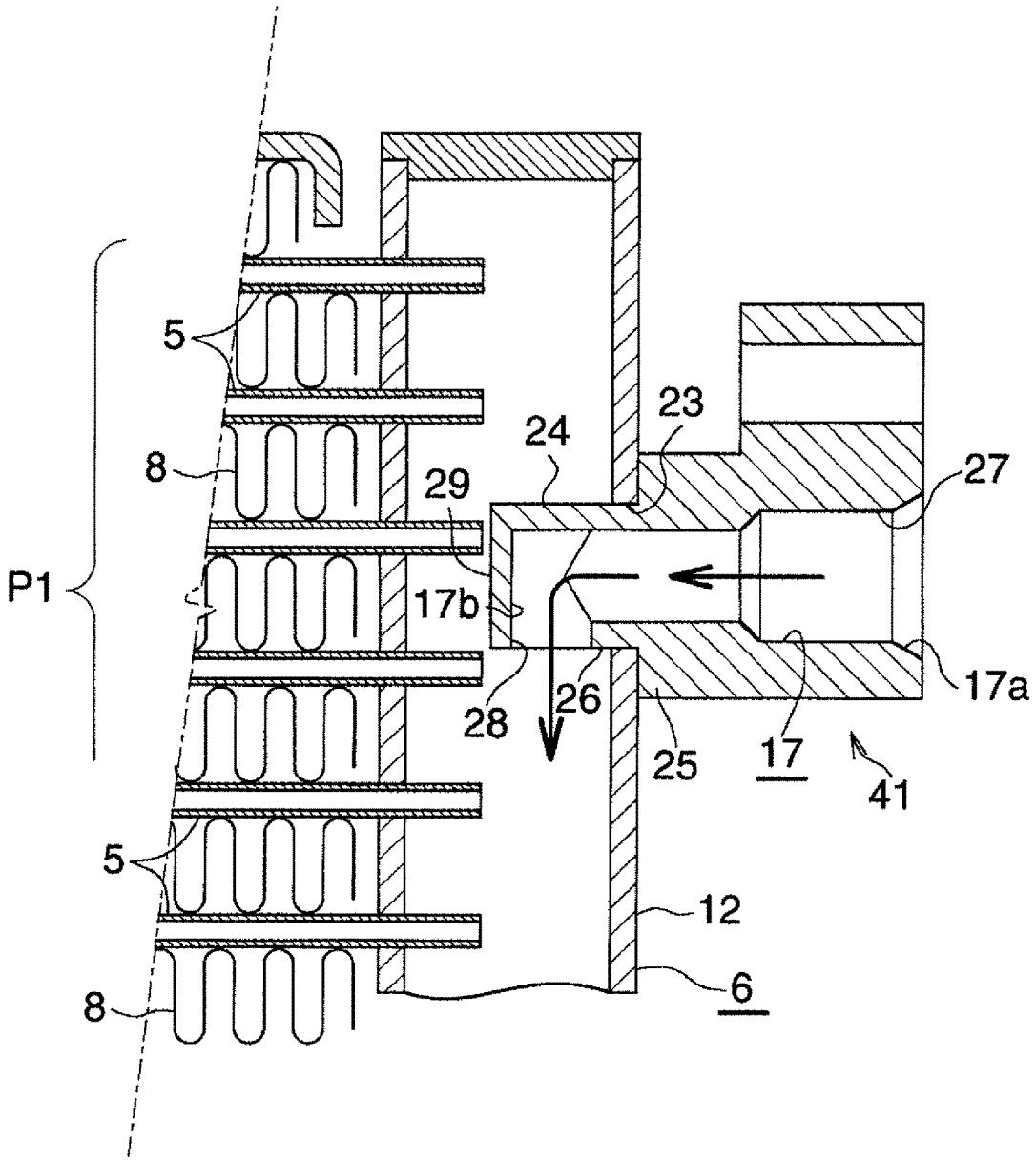
FIG. 13 is a view corresponding to FIG. 4 and showing a main portion of the condenser of FIG. 11.

FIGS. 11 through 13 show a second embodiment of the condenser according to the present invention. FIG. 11 specifically shows the overall structure of the second embodiment of the condenser according to the present invention. FIG. 12 schematically shows the condenser of FIG. 11. In FIG. 12, the individual heat exchange tubes 5 are not illustrated, and the corrugate fins and the side plates are also not illustrated. FIG. 13 shows a main portion of the condenser of FIG. 11.

In FIGS. 11 through 13, an inlet member 41 formed of aluminum is brazed to a portion of the condensation section inlet header 12 of the right header tank 6 of a condenser 40, the portion being offset from the longitudinal center of the condensation section inlet header 12 toward the upper end thereof. The inlet member 41 has a refrigerant inflow passage 17 which is open at opposite ends and through which refrigerant flows into the condensation section inlet header 12. The inlet member 41 is obtained by inverting the inlet member 16 used in the condenser 1 of the above-described first embodiment. The inlet member 41 is brazed to the outer circumferential surface of the circumferential wall of the condensation section inlet header 12 in a state in which the insert portion 24 is inserted into the condensation section inlet header 12 through the opening 23 formed in the condensation section inlet header 12 at a position offset toward the upper end from the longitudinal center of the condensation section inlet header 12, and the close contact portion 25 is brought into close contact with a portion of the outer circumferential surface of the circumferential wall of the condensation section inlet header 12, the portion extending around the opening 23. The insert portion 24 does not interfere with the heat exchange tubes 5 of the first heat exchange path P1, and a gap 29 is present between the insert portion 24 and the circumferential wall of the condensation section inlet header 12.

The communication members 21 and 22 formed of aluminum and brazed to the left header tank 7 and the liquid receiver 4 respectively establish the communication between a lower portion of the interior space of the condensation section outlet header 13 and a lower portion of the interior space of the liquid receiver 4 and the communication between an upper portion of the interior space of the super-cooling section inlet header 14 and a lower portion of the interior space of the liquid receiver 4. As a result, refrigerant flowing out of the condensation section outlet header 13 flows into the super-cooling section inlet header 14 through the liquid receiver 4.

The remaining structure is the same as the condenser of the first embodiment.

Figure 14:
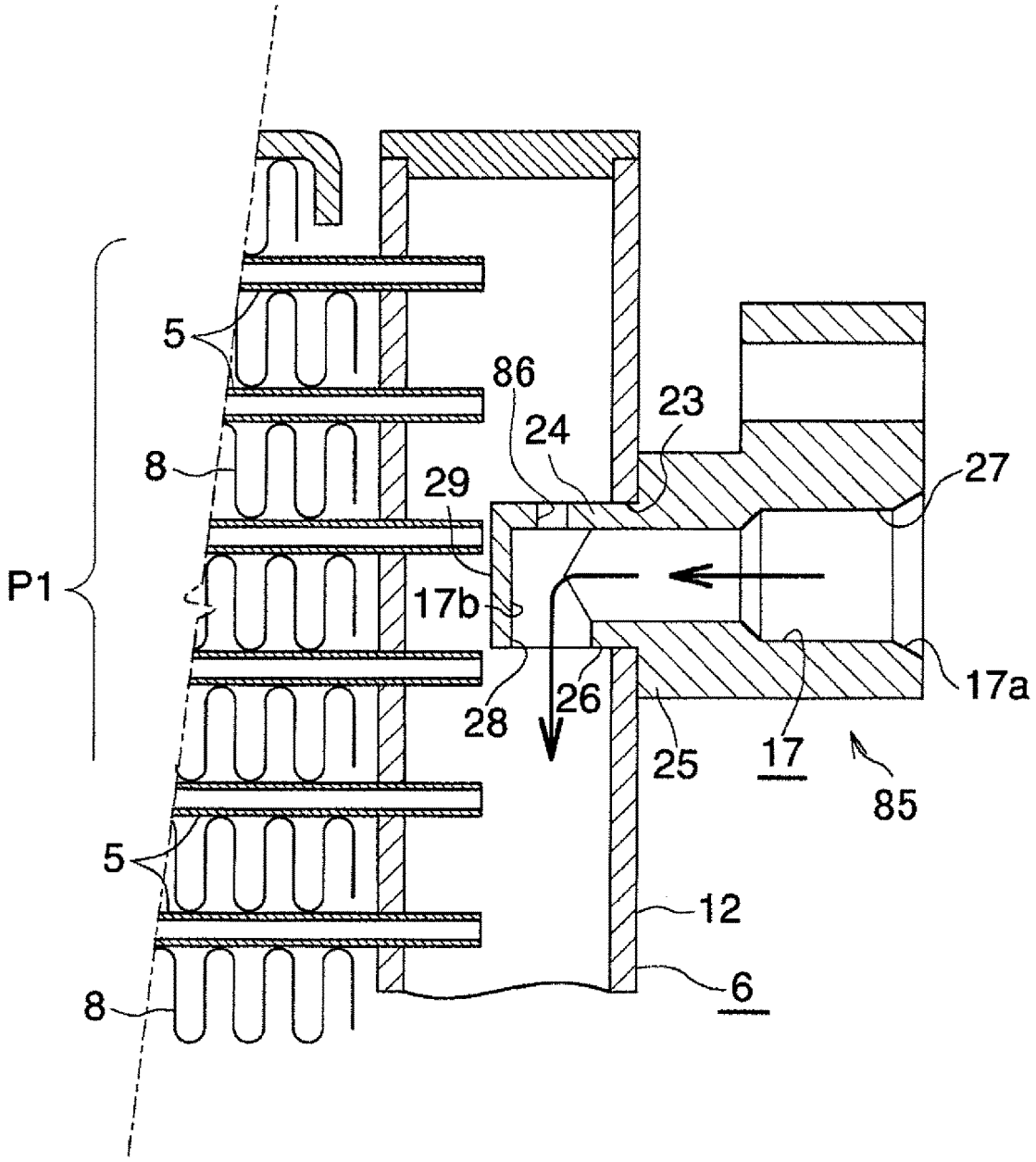
FIG. 14 is a view corresponding to FIG. 13 and showing a modification of the inlet member used in the condenser of FIG. 11.

FIG. 14 shows a modification of the inlet member used in the condenser 40 shown in FIGS. 11 and 12.

An inlet member 85 shown in FIG. 14 is obtained by inverting the inlet member 70 shows in FIG. 8, and a vertical auxiliary refrigerant inflow passage 86 is formed in the insert portion 24. One end of the auxiliary refrigerant inflow passage 86 is open to the top surface of the second straight portion 17*b* of the refrigerant inflow passage 17, and the other end of the auxiliary refrigerant inflow passage 86 is open to an upper surface of the insert portion 24, which surface faces toward the side opposite the longitudinal center of the condensation section inlet header 12. The flow passage cross sectional area of the auxiliary refrigerant inflow passage 86 is constant over the entire length and is smaller than that of the second straight portion 17*b* of the refrigerant inflow passage 17. The size of the upper end opening of the auxiliary refrigerant inflow passage 86 is smaller than that of the outflow opening 28.

Notably, in the condenser 40 of the second embodiment, the inlet members 30, 35, 75, and 80 shown in FIGS. 6, 7, 9, and 10 may be used in an inverted state (upside down).

Figure 15:
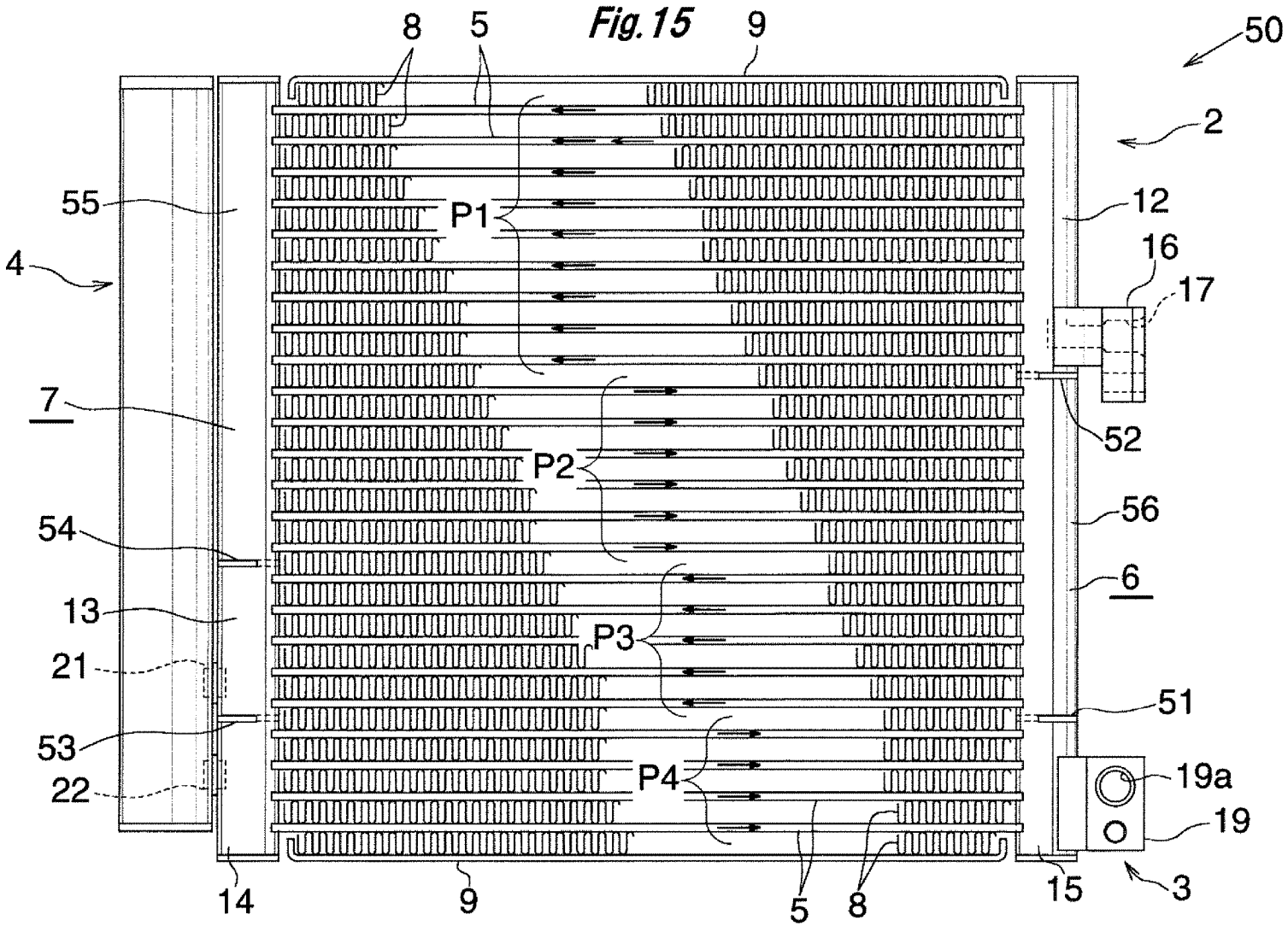
FIG. 15 is a front view specifically showing the overall structure of a third embodiment of the condenser according to the present invention.
Figure 16:
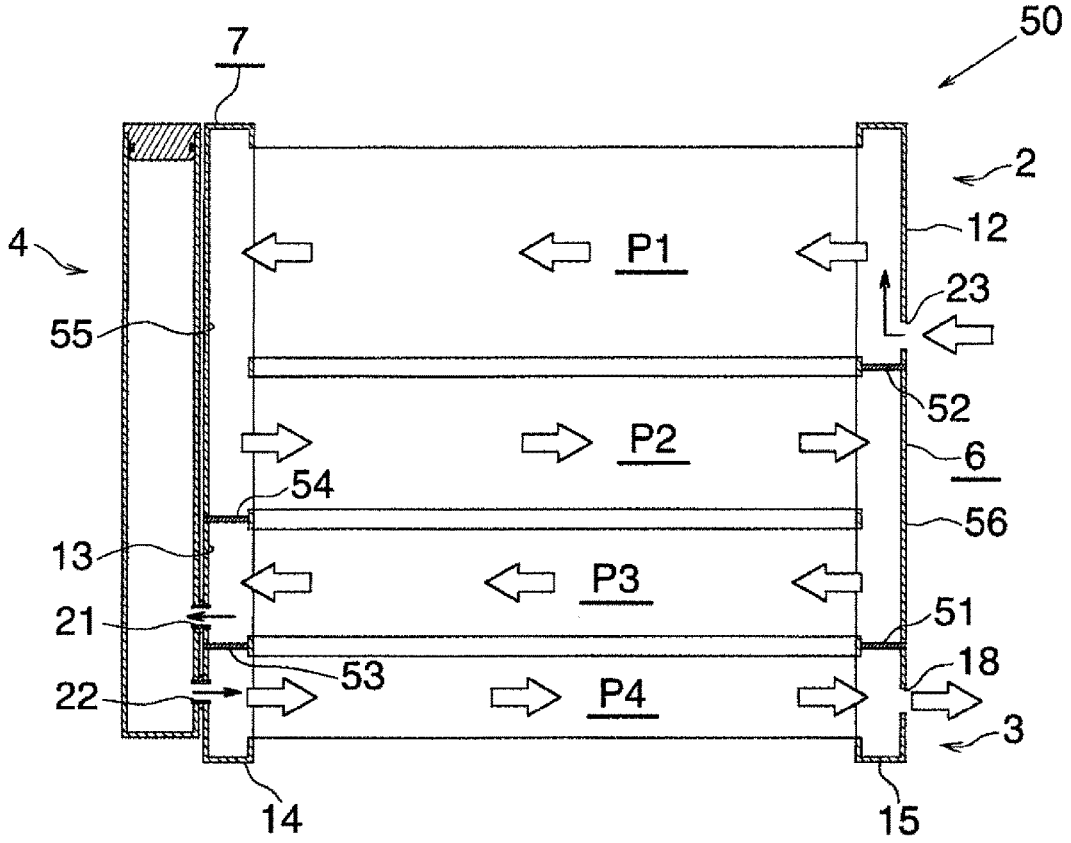
FIG. 16 is a front view schematically showing the condenser of FIG. 15.

FIGS. 15 and 16 show a third embodiment of the condenser according to the present invention. FIG. 15 specifically shows the overall structure of the third embodiment of the condenser according to the present invention, and FIG. 16 schematically shows the condenser of FIG. 15. In FIG. 16, the individual heat exchange tubes are not illustrated, and the corrugate fins and the side plates are also not illustrated.

In FIGS. 15 and 16, the condensation section 2 of a condenser 50 includes at least one heat exchange path (in the present embodiment, three heat exchange paths P1, P2, and P3) formed by a plurality of heat exchange tubes 5 successively arranged in the vertical direction. Also, the super-cooling section 3 of the condenser 50 includes at least one heat exchange path (in the present embodiment, one heat exchange path P4) formed by a plurality of heat exchange tubes 5 successively arranged in the vertical direction. The flow direction of refrigerant is the same among all the heat exchange tubes 5 which form each heat exchange path P1, P2, P3, or P4. The flow direction of refrigerant in the heat exchange tubes 5 which form a certain heat exchange path is opposite the flow direction of refrigerant in the heat exchange tubes 5 which form another heat exchange path adjacent to the certain heat exchange path. The three heat exchange paths P1, P2, and P3 of the condensation section 2 will be referred to as the first through third heat exchange paths, and the heat exchange path P4 of the super-cooling section 3 will be referred to as the fourth heat exchange path.

The interior space of the right header tank 6 is divided into three sections arranged in the vertical direction by a first partition member 51 formed of aluminum and provided between the third heat exchange path P3 and the fourth heat exchange path P4 and a second partition member 52 formed of aluminum and provided between the first heat exchange path P1 and the second heat exchange path P2. The interior space of the left header tank 7 is divided into three sections arranged in the vertical direction by a third partition member 53 formed of aluminum and provided between the third heat exchange path P3 and the fourth heat exchange path P4; i.e., provided at the same height as the first partition member 51, and a fourth partition member 54 formed of aluminum and provided between the second heat exchange path P2 and the third heat exchange path P3. A portion of the condenser 50 located above the first and third partition members 51 and 53 serves as the condensation section 2, and a portion of the condenser 50 located below the two partition members 51 and 53 serves as the super-cooling section 3. Since the three first heat exchange paths P1, P2, and P3 are provided in the condensation section 2, the section of the right header tank 6 located above the second partition member 52 serves as the condensation section inlet header 12, and the section of the left header tank 7 located above the fourth partition member 54 serves as a first intermediate header 55, the section of the right header tank 6 located between the first partition member 51 and the second partition member 52 serves as a second intermediate header 56, and the section of the left header tank 7 located between the third partition member 53 and the fourth partition member 54 serves as the condensation section outlet header 13. Since the single fourth heat exchange path P4 is provided in the super-cooling section 3, the section of the left header tank 7 located below the third partition member 53 serves as the super-cooling section inlet header 14, and the section of the right header tank 6 located below the first partition member 51 serves as the super-cooling section outlet header 15.

The aluminum inlet member 16 used in the condenser 1 of the first embodiment is brazed to the outer circumferential surface of the circumferential wall of the condensation section inlet header 12 to be located at a position offset from its longitudinal center toward one end (lower end in the present embodiment) thereof. The inlet member 16 is brazed to the outer circumferential surface of the circumferential wall of the condensation section inlet header 12 in a state in which the insert portion 24 is inserted into the condensation section inlet header 12 through the opening 23 formed in the condensation section inlet header 12 at a position offset from the longitudinal center of the condensation section inlet header 12 toward the upper end thereof, and the close contact portion 25 is brought into close contact with a portion of the outer circumferential surface of the circumferential wall of the condensation section inlet header 12, the portion extending around the opening 23.

The remaining structure is the same as the condenser of the first embodiment. Notably, in this embodiment, the inlet members 30, 35, 70, 75, and 80 shown in FIGS. 6 through 10 may be used.

The condenser 50 constitutes a refrigeration cycle in cooperation with a compressor, an expansion valve (pressure reducer), and an evaporator; and the refrigeration cycle is mounted on a vehicle as a car air conditioner.

In the condenser 50 having the above-described structure, gas phase refrigerant of high temperature and high pressure compressed by the compressor flows into a lower portion of the interior space of the condensation section inlet header 12 through the refrigerant inflow passage 17 of the inlet member 16. At that time, the refrigerant flows out upward (toward the longitudinal center of the condensation section inlet header 12) from the outflow opening 28 of the inlet member 16. Therefore, a large part of the refrigerant flows to an upper end portion of the interior space of the condensation section inlet header 12, and the remaining refrigerant flows to a region below the inlet member 16 through the gap 29 between the insert portion 24 of the inlet member 16 and the circumferential wall of the condensation section inlet header 12. Accordingly, the refrigerant having flowed into the interior space of the condensation section inlet header 12 through the refrigerant inflow passage 17 of the inlet member 16 spreads to the entire interior space of the condensation section inlet header 12, and flows into all the heat exchange tubes 5 of the first heat exchange path P1 connected to the condensation section inlet header 12 while being equally divided among all the heat exchange tubes 5. The refrigerant having flowed into the heat exchange tubes 5 of the first heat exchange path P1 flows leftward within the heat exchange tubes 5 of the first heat exchange path P1 and flows into the first intermediate header 55. Subsequently, the refrigerant flows rightward within the heat exchange tubes 5 of the second heat exchange path P2 and flows into the second intermediate header 56. Subsequently, the refrigerant flows leftward within the heat exchange tubes 5 of the third heat exchange path P3 and flows into the condensation section outlet header 13. The refrigerant having flowed into the condensation section outlet header 13 flows into the liquid receiver 4 through the communication member 21.

The refrigerant having flowed into the liquid receiver 4 is in a gas-liquid mixed phase, and liquid phase predominant refrigerant which is a portion of the gas-liquid mixed phase refrigerant accumulates in a lower portion of the interior space of the liquid receiver 4 due to the gravitational force, and enters the super-cooling section inlet header 14 through the communication member 22. The refrigerant having entered the super-cooling section inlet header 14 enters the heat exchange tubes 5 of the fourth heat exchange path P4 and is super-cooled while flowing rightward within the flow channels of the heat exchange tubes 5 of the fourth heat exchange path P4. Subsequently, the super-cooled refrigerant enters the super-cooling section outlet header 15 and flows out through the refrigerant outlet 18 and the refrigerant outflow passage 19*a* of the outlet member 19. The refrigerant is then fed to the evaporator through the expansion valve.

In the above-described condensers 1, 40, and 50 of the first through third embodiments, the super-cooling section 3 is provided below the condensation section 2. However, the layout of the condensation section 2 and the super-cooling section 3 is not limited thereto, and the super-cooling section may be provided above the condensation section. For example, the present invention can be applied to a condenser which includes a condensation section; a super-cooling section provided above the condensation section; and a liquid receiver provided between the condensation section and the super-cooling section, wherein refrigerant flowing out of the condensation section flows into the super-cooling section through the liquid receiver; the liquid receiver has a refrigerant inlet through which refrigerant flows from the condensation section into the liquid receiver and a refrigerant outlet which is located above the refrigerant inlet and through which refrigerant flows out of the liquid receiver into the super-cooling section; a partition member is provided in the liquid receiver at a vertical position between the refrigerant inlet and the refrigerant outlet in order to divide the interior space of the liquid receiver into upper and lower spaces; i.e., a first space located below the partition member and communicating with the refrigerant inlet and a second space located above the partition member and communicating with the refrigerant outlet; and a suction pipe for establishing communication between the first space and the second space is disposed in the liquid receiver.

Figure 17:
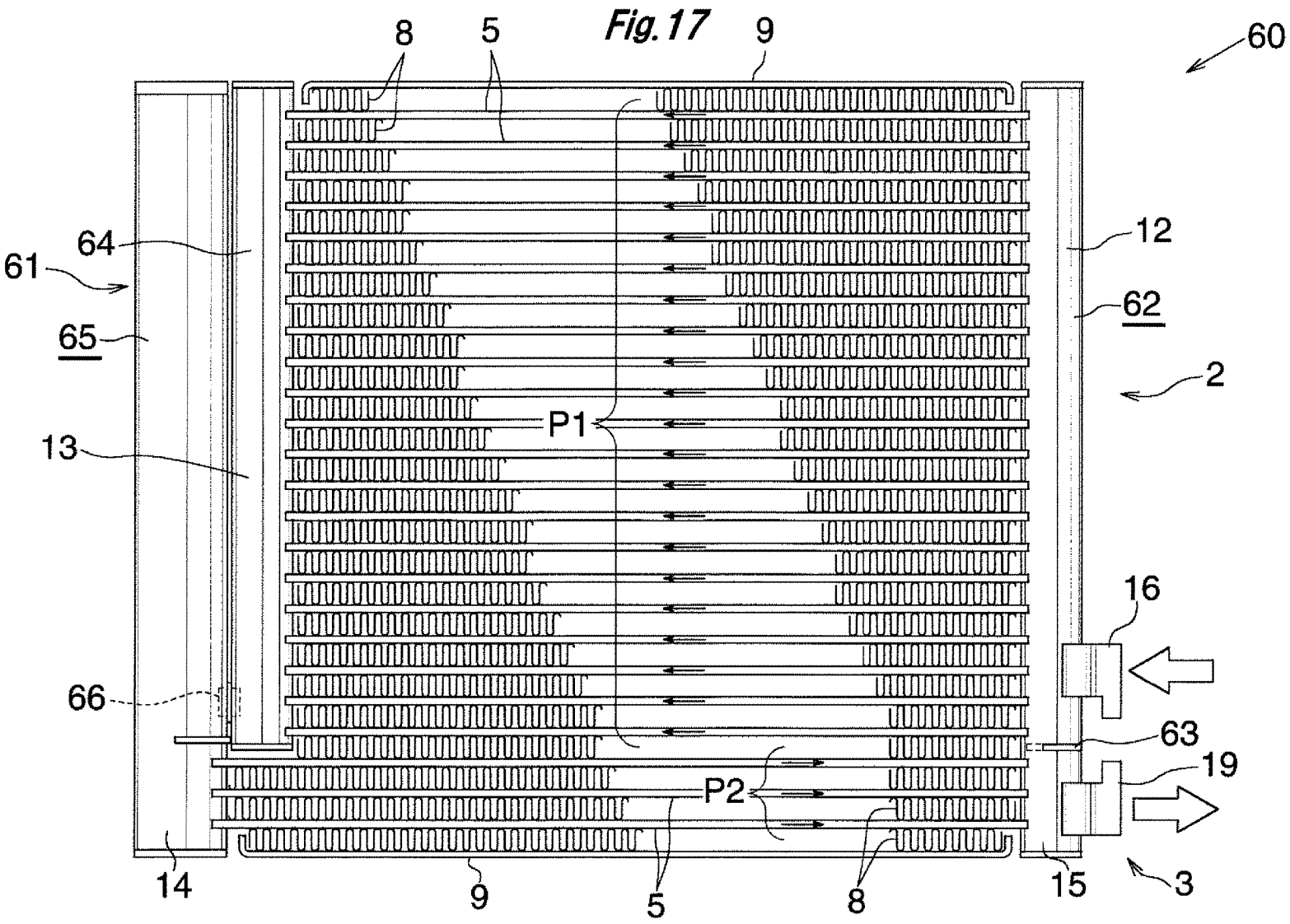
FIG. 17 is a front view specifically showing the overall structure of a fourth embodiment of the condenser according to the present invention.
Figure 18:
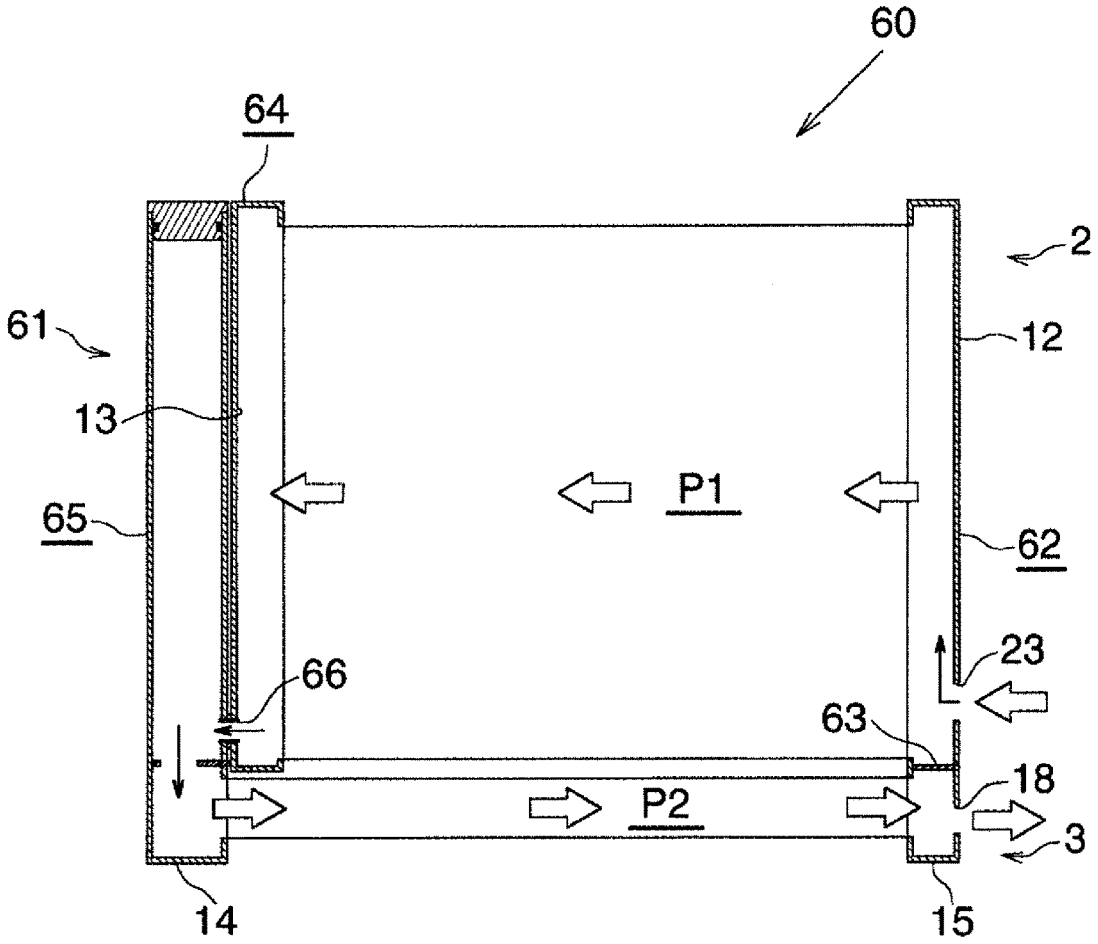
FIG. 18 is a front view schematically showing the condenser of FIG. 17.

FIGS. 17 and 18 show a fourth embodiment of the condenser according to the present invention. FIG. 17 specifically shows the overall structure of the fourth embodiment of the condenser according to the present invention, and FIG. 18 schematically shows the condenser of FIG. 17. In FIG. 18, the individual heat exchange tubes are not illustrated, and the corrugate fins and the side plates are also not illustrated.

In FIGS. 17 and 18, a condenser 60 includes a condensation section 2; a super-cooling section 3 provided below the condensation section 2; and a liquid receiving section 61 which is provided between the condensation section 2 and the super-cooling section 3 such that its longitudinal direction coincides with the vertical direction and which has a gas liquid separation function.

Each of the condensation section 2 and the super-cooling section 3 of the condenser 60 includes at least one heat exchange path (in the present embodiment, one heat exchange path P1, P2) formed by a plurality of heat exchange tubes 5 successively arranged in the vertical direction. The heat exchange path P1 provided in the condensation section 2 serves as a refrigerant condensation path. The heat exchange path P2 provided in the super-cooling section 3 serves as a refrigerant super-cooling path. The flow direction of refrigerant is the same among all the heat exchange tubes 5 which form the respective heat exchange paths P1, P2. The flow direction of refrigerant in the heat exchange tubes 5 which form a certain heat exchange path is opposite the flow direction of refrigerant in the heat exchange tubes 5 which form another heat exchange path adjacent to the certain heat exchange path. The heat exchange path P1 of the condensation section 2 will be referred to as the first heat exchange path P1, and the heat exchange path P2 of the super-cooling section 3 will be referred to as the second heat exchange path P2. In the present embodiment, since the single first heat exchange path P1 is provided in the condensation section 2, the first heat exchange path P1 serves as a heat exchange path located furthest upstream in the refrigerant flow direction in the condensation section 2 and also serves as a heat exchange path located furthest downstream in the refrigerant flow direction in the condensation section 2.

A first header tank 62 is disposed on the right end side of the condenser 60, and the right ends of all the heat exchange tubes 5 forming the first and second heat exchange paths P1 and P2 are connected to the first header tank 62. The interior space of the first header tank 62 is divided into upper and lower sections by a partition member 63 which is formed of aluminum and is provided at a vertical position between the first heat exchange path P1 and the second heat exchange path P2. A condensation section inlet header 12 is provided in the section of the first header tank 62 located above the partition member 63, and the upstream end (in the refrigerant flow direction) of the first heat exchange path P1 of the condensation section 2 communicates with the condensation section inlet header 12. A super-cooling section outlet header 15 is provided in the section of the first header tank 62 located below the partition member 63, and the downstream end (in the refrigerant flow direction) of the second heat exchange path P2 of the super-cooling section 3 communicates with the super-cooling outlet header 15.

A second header tank 64 and a third header tank 65 are separately provided on the left end side of the condenser 60 such that the third header tank 65 is located on the outer side in the left-right direction. The left ends of all the heat exchange tubes 5 of the first exchange path P1 provided in the condensation section 2 are connected to the second header tank 64 by means of brazing. The left ends of all the heat exchange tubes 5 of the second exchange path P2 provided in the super-cooling section 3 are connected to the second header tank 64 by means of brazing. The upper end of the third header tank 65 is located above the lower end of the second header tank 64; in the present embodiment, is located at approximately the same vertical position as the upper end of the second header tank 64. Also, the lower end of the third header tank 65 is located below the lower end of the second header tank 64. The heat exchange tubes 5 forming the second heat exchange path P2 are brazed to a portion of the third header tank 65 located below the second header tank 64. The third header tank 65 also serves as the liquid receiving section 61 which has the function of the liquid reservoir section which reserves liquid phase predominant refrigerant produced as a result of condensation at the condensation section 2 and supplies the liquid phase predominant refrigerant to the super-cooling section 3.

A condensation section outlet header 13 is provided in the entirety of the second header tank 64, and the downstream end (in the refrigerant flow direction) of the first heat exchange path P1 of the condensation section 2 communicates with the condensation section outlet header 13. A super-cooling section inlet header 14 is provided in a portion of the third header tank 65 located below the lower end of the second header tank 64, and the upstream end (in the refrigerant flow direction) of the second heat exchange path P2 of the super-cooling section 3 communicates with the super-cooling section inlet header 14. A lower end portion of the interior space of the condensation section outlet header 13 of the second header tank 64 communicates, through a communication member 66, with a portion of the interior space of the third header tank 65, which portion is located above the super-cooling section inlet header 14. Notably, the portion of the interior space of the third header tank 65, which portion is located above the super-cooling section inlet header 14, communicates with the super-cooling section inlet header 14 within the third header tank 65.

The aluminum inlet member 16 used in the condenser 1 of the first embodiment is brazed to the outer circumferential surface of the circumferential wall of the condensation section inlet header 12 to be located at a position offset from its longitudinal center toward one end (lower end in the present embodiment) thereof. The inlet member 16 is brazed to the outer circumferential surface of the circumferential wall of the condensation section inlet header 12 in a state in which the insert portion 24 is inserted into the condensation section inlet header 12 through the opening 23 formed in the condensation section inlet header 12 at a position offset toward the lower end from the longitudinal center of the condensation section inlet header 12, and the close contact portion 25 is brought into close contact with a portion of the outer circumferential surface of the circumferential wall of the condensation section inlet header 12, the portion extending around the opening 23.

The remaining structure is the same as the condenser of the first embodiment. Notably, in this embodiment, the inlet members 30, 35, 70, 75, and 80 shown in FIGS. 6 through 10 may be used.

The condenser 60 constitutes a refrigeration cycle in cooperation with a compressor, an expansion valve (pressure reducer), and an evaporator; and the refrigeration cycle is mounted on a vehicle as a car air conditioner.

In the condenser 60 having the above-described structure, gas phase refrigerant of high temperature and high pressure compressed by the compressor flows into a lower portion of the interior space of the condensation section inlet header 12 through the refrigerant inflow passage 17 of the inlet member 16. At that time, the refrigerant flows out upward (toward the longitudinal center of the condensation section inlet header 12) from the outflow opening 28 of the inlet member 16. Therefore, a large part of the refrigerant flows to an upper end portion of the interior space of the condensation section inlet header 12, and the remaining refrigerant flows to a region below the inlet member 16 through the gap 29 between the insert portion 24 of the inlet member 16 and the circumferential wall of the condensation section inlet header 12. Accordingly, the refrigerant having flowed into the interior space of the condensation section inlet header 12 through the refrigerant inflow passage 17 of the inlet member 16 spreads to the entire interior space of the condensation section inlet header 12, and flows into all the heat exchange tubes 5 of the first heat exchange path P1 connected to the condensation section inlet header 12 while being equally divided among all the heat exchange tubes 5. The refrigerant having flowed into the heat exchange tubes 5 of the first heat exchange path P1 flows leftward within the heat exchange tubes 5 of the first heat exchange path P1 and flows into the condensation section outlet header 13 of the second header tank 64. The refrigerant having flowed into the condensation section outlet header 13 of the second header tank 64 flows through the communication member 66 and flows into the portion of the interior space of the third header tank 65 located above the super-cooling section inlet header 14.

The refrigerant having flowed into the portion of the interior space of the third header tank 65 located above the super-cooling section inlet header 14 is in a gas-liquid mixed phase, and liquid phase predominant refrigerant which is a portion of the gas-liquid mixed phase refrigerant accumulates within the super-cooling section inlet header 14 of third header tank 65, and enters the heat exchange tubes 5 of the second heat exchange path P2. The refrigerant having entered the heat exchange tubes 5 of the second heat exchange path P2 is super-cooled while flowing rightward within the heat exchange tubes 5 of the second heat exchange path P2. Subsequently, the super-cooled refrigerant enters the super-cooling section outlet header 15 of the first header tank 62 and flows out through the refrigerant outlet 18 and the refrigerant outflow passage 19*a* of the outlet member 19. The refrigerant is then fed to the evaporator through the expansion valve.

What is claimed is:

1. A condenser comprising:

a condensation section inlet header disposed such that its longitudinal direction coincides with a vertical direction;

a heat exchange path formed by a plurality of heat exchange tubes disposed parallel to one another such that their longitudinal direction coincides with a left-right direction and they are spaced from one another in the vertical direction, each of heat exchange tubes being connected, at one longitudinal end thereof, to the condensation section inlet header; and an inlet member joined to the condensation section inlet header, the inlet member having a refrigerant inflow passage which is open at opposite ends thereof and through which refrigerant flows to a region within the condensation section inlet header, the region being offset from a longitudinal center of the condensation section inlet header toward one end of the condensation section inlet header, an opening at one end of the refrigerant inflow passage of the inlet member serving as an inflow opening into which the refrigerant flows from the outside, and an opening at the other end of the refrigerant inflow passage serving as an outflow opening from which the refrigerant flows out to the condensation section inlet header, wherein the condensation section inlet header has an opening formed in a circumferential wall of the condensation section inlet header at a position offset from the longitudinal center toward the one end of the condensation section inlet header;

the inlet member has an insert portion which is inserted into the condensation section inlet header through the opening;

the outflow opening of the refrigerant inflow passage is open to a surface of the insert portion; and the outflow opening of the refrigerant inflow passage is oriented such that the refrigerant flows toward the longitudinal center of the condensation section inlet header.

2. The condenser according to claim 1, wherein the outflow opening of the inlet member is located on a single flat surface of the insert portion, and a straight line orthogonal to the flat surface extends in the longitudinal direction of the condensation section inlet header.

3. The condenser according to claim 2, wherein the straight line orthogonal to the single flat surface where the outflow opening of the inlet member is located is located on a plane perpendicularly intersecting an air-passing direction.

4. The condenser according to claim 3, wherein the refrigerant inflow passage of the inlet member has a straight portion located on a side toward the outflow opening and having a predetermined length, and the straight portion is inclined such that the straight portion approaches the longitudinal center of the condensation section inlet header and the heat exchange tube while extending from an inflow opening side toward the outflow opening side.

5. The condenser according to claim 1, wherein the outflow opening of the insert portion is located on a single flat surface of the insert portion, a straight line which passes through the center of the outflow opening and is orthogonal to the flat surface is inclined such that the distance of separation from a straight line which passes through the center of the outflow opening and extends in the longitudinal direction of the condensation section inlet header increases with the distance of separation from the flat surface toward the longitudinal center of the condensation section inlet header, and the two straight lines form a predetermined angle therebetween.

6. The condenser according to claim 5, wherein the angle formed between the straight line orthogonal to the single flat surface of the insert portion where the outflow opening of the inlet member is located and the straight line extending in the longitudinal direction of the condensation section inlet header falls within a range of 0° to 45°, excluding 0°.

7. The condenser according to claim 5, wherein the straight line orthogonal to the single flat surface of the insert portion where the outflow opening of the inlet member is located is located on a plane perpendicularly intersecting an air-passing direction.

8. The condenser according to claim 1, wherein the inlet member has an auxiliary refrigerant inflow passage formed in the insert portion of the inlet member, one end of the auxiliary refrigerant inflow passage being open to a wall surface of the refrigerant inflow passage, the other end of the auxiliary refrigerant inflow passage being open to a surface of the insert portion which faces toward a side opposite the longitudinal center of the condensation section inlet header, and an opening at the other end of the auxiliary refrigerant inflow passage is smaller in size than the outflow opening.

* * * * *